US006089653A

United States Patent [19]

Hotaling et al.

[11] Patent Number: 6,089,653

[45] Date of Patent: Jul. 18, 2000

[54] ADJUSTABLE HIGH CHAIR AND CARRIER

[75] Inventors: Bryan R. Hotaling, Arlington; Jon R. Rossman, Chelmsford; Gerard J. Kaelblein, N. Attleboro; James J. Britto, Westport, all of Mass.

[73] Assignee: The First Years Inc., Mission Viejo, Calif.

[21] Appl. No.: 09/161,212

[22] Filed: Sep. 25, 1998

Related U.S. Application Data

[63] Continuation-in-part of application No. 08/938,506, Sep. 26, 1997, abandoned.

[51] Int. Cl.[7] ..... A47C 13/00

[52] U.S. Cl. ..... 297/130; 297/183.2; 297/354.12

[58] Field of Search ..... 297/130, 250.1, 297/256.16, 256.15, 467, 326, 327, 328, 183.1, 183.3, 183.2, 183.4, 183.9, 188.04, 188.05, 118, 310, 325, 377, 256.13, 270.2, 270.5

[56] References Cited

U.S. PATENT DOCUMENTS

| | | | |
|---|---|---|---|
| D. 138,067 | 6/1944 | Morando . | |
| D. 147,540 | 9/1947 | Engelberg et al. . | |
| D. 148,068 | 12/1947 | Huber . | |
| D. 177,231 | 3/1956 | Hail et al. . | |
| D. 181,975 | 1/1958 | Hail et al. . | |
| D. 246,682 | 12/1977 | Nakao | D6/7 |
| D. 278,483 | 4/1985 | Takada | D6/333 |
| 284,671 | 9/1883 | Reed . | |
| D. 290,429 | 6/1987 | Lemmeyer | D6/333 |
| D. 291,156 | 8/1987 | Nakao et al. | D6/338 |
| D. 297,684 | 9/1988 | Taylor, Sr. | D6/335 |
| D. 344,189 | 2/1994 | Golenz et al. | D6/339 |
| D. 365,050 | 12/1995 | Shimer et al. | D12/130 |
| 373,296 | 11/1887 | Mann et al. . | |
| 628,166 | 7/1899 | Sheridan . | |
| 930,074 | 8/1909 | Jaspersen . | |
| 1,967,096 | 7/1934 | McCoy . | |
| 2,362,465 | 11/1944 | Carner . | |
| 2,532,812 | 12/1950 | Huber . | |
| 2,562,629 | 7/1951 | Miles . | |
| 2,731,072 | 1/1956 | Post . | |
| 2,790,484 | 4/1957 | Pollack . | |
| 2,984,291 | 5/1961 | Kostenborder et al. . | |
| 3,131,968 | 5/1964 | Alt . | |
| 3,572,827 | 3/1971 | Merelis | 297/253 |
| 3,649,074 | 3/1972 | McDonald et al. | 297/153 |
| 4,065,175 | 12/1977 | Perego | 297/130 |

(List continued on next page.)

FOREIGN PATENT DOCUMENTS

| | | |
|---|---|---|
| 0755643 A1 | 1/1997 | European Pat. Off. . |
| 4106 | 12/1890 | United Kingdom . |
| 464806 | 4/1937 | United Kingdom . |

OTHER PUBLICATIONS

Advertisement for "Baby Batik" Adjustable High Chair, prior art.

Advertisement: Cosco "Rise & Dine High Chair," prior art.

Advertisement: Evenflow "Phases™ High Chair", 1995.

Advertisement: Playschool 1•2•3 High Chair, prior art.

Advertisement: Catalog p. 18 "Models 2344 and 2346 The Champ™ Adjustable High Chair," prior art.

Advertisement: Catalog p. 18 "Model 2326 Convertible High Chair," prior art.

*Primary Examiner*—Milton Nelson, Jr.
*Attorney, Agent, or Firm*—Fish & Richardson P.C.

[57] ABSTRACT

A chair and carrier assembly comprises a base, a carrier receiving support mounted to the base and adapted to receive a carrier, and a carrier removably received in the carrier receiving support. The carrier includes a seat, for holding a child, and a handle including arms joined by a cross member, the arms being pivotally mounted to the seat, and including an elongated member transversely extending from the cross member for carrying the carrier when the handle is in a first position and for providing a passive restraint for the child when the handle is in a second position. The carrier is removable from the carrier receiving support.

23 Claims, 28 Drawing Sheets

U.S. PATENT DOCUMENTS

| | | | |
|---|---|---|---|
| 4,065,177 | 12/1977 | Hyde et al. | 297/327 |
| 4,072,318 | 2/1978 | Laune | 280/42 |
| 4,082,349 | 4/1978 | Ballenger | 297/183 |
| 4,105,247 | 8/1978 | Saint | 297/149 |
| 4,231,612 | 11/1980 | Meeker | 297/250 |
| 4,288,123 | 9/1981 | Cone | 297/154 |
| 4,516,806 | 5/1985 | McDonald et al. | 297/457 |
| 4,561,621 | 12/1985 | Hill | 248/397 |
| 4,582,359 | 4/1986 | Wise et al. | 297/151 |
| 4,606,576 | 8/1986 | Jones | 297/153 |
| 4,632,456 | 12/1986 | Kassai | 297/328 |
| 4,697,845 | 10/1987 | Kamman | 297/118 |
| 4,722,570 | 2/1988 | Bertoli | 297/345 |
| 4,723,813 | 2/1988 | Kassai | 297/153 |
| 4,733,909 | 3/1988 | Single, II et al. . | |
| 4,744,599 | 5/1988 | Jankowski et al. | 297/250 |
| 4,807,928 | 2/1989 | Cone | 297/153 |
| 4,818,016 | 4/1989 | Mariol et al. | 297/174 |
| 4,819,988 | 4/1989 | Hellstrom | 297/467 |
| 4,842,331 | 6/1989 | Waples | 297/149 |
| 4,858,997 | 8/1989 | Shubin | 297/487 |
| 4,915,446 | 4/1990 | Darling et al. | 297/250 |
| 4,938,603 | 7/1990 | Turner et al. | 297/16 |
| 4,943,113 | 7/1990 | Meeker | 297/250 |
| 4,962,965 | 10/1990 | Glover | 297/467 |
| 4,971,389 | 11/1990 | Staggs et al. | 297/174 |
| 5,087,097 | 2/1992 | Hehn | 297/153 |
| 5,118,161 | 6/1992 | Slowe et al. | 297/153 |
| 5,141,286 | 8/1992 | Ayala, Jr. et al. | 297/464 |
| 5,165,755 | 11/1992 | Rho | 297/345 |
| 5,195,770 | 3/1993 | Ishikura | 280/648 |
| 5,207,476 | 5/1993 | Payne | 297/183 |
| 5,238,292 | 8/1993 | Golenz et al. | 297/153 |
| 5,249,838 | 10/1993 | Kulpa et al. | 297/328 |
| 5,332,241 | 7/1994 | Rho | 297/344.14 |
| 5,346,279 | 9/1994 | Pecorella | 297/256.1 |
| 5,348,374 | 9/1994 | Kuo | 297/344.18 |
| 5,364,137 | 11/1994 | Shimer | 297/327 |
| 5,366,271 | 11/1994 | Johnston et al. | 297/250.1 |
| 5,413,399 | 5/1995 | Myers et al. | 297/118 |
| 5,468,043 | 11/1995 | Chien | 297/153 |
| 5,489,138 | 2/1996 | Mariol et al. | 297/151 |
| 5,507,550 | 4/1996 | Maloney | 297/153 |
| 5,527,096 | 6/1996 | Shimer | 297/327 |
| 5,533,786 | 7/1996 | Cone, II | 297/256.15 |
| 5,562,330 | 10/1996 | Cabagnero | 297/42 |
| 5,564,778 | 10/1996 | Shimer et al. | 297/130 |
| 5,806,922 | 9/1998 | Mendelovich | 297/130 |

ADJUSTABLE HIGH CHAIR AND CARRIER

This application is a continuation-in-part application of U.S. Ser. No. 08/938,506 filed Sep. 26, 1997 and now abandoned.

BACKGROUND OF THE INVENTION

This invention relates to adjustable-height and adjustable-reclining chairs, and in particular, an adjustable high chair with a removably attached carrier for holding a child.

As children grow and develop over the first several years of their lives, their needs change. It is desirable to have a single chair that can be adapted to meet their changing size and needs.

An adjustable-height chair for securely holding a child in an upright and elevated position is commonly used for feeding the child. The height of the chair may be adjusted for the convenience of the child based on the child's size, or to suit the needs of persons feeding the child.

It is also convenient to transport a young child without having to remove the child from the child's seat, which might result in disrupting the child. Thus, a multi-purpose portable seat for securely holding a child in different positions for different purposes is desirable.

Moreover, as a child grows, it may be necessary to adjust the angle or reclining position of the child when placed in either an adjustable-height chair or a portable seat, depending on the size and age of the child.

SUMMARY OF THE INVENTION

In general, in one aspect, the invention features a chair and carrier assembly comprising a base, a carrier receiving support mounted to the base and adapted to receive a carrier, and a carrier removably received in the carrier receiving support. The carrier includes a seat, for holding a child, and a handle including arms joined by a cross member, the arms being pivotally mounted to the seat, and including an elongated member transversely extending from the cross member for carrying the carrier when the handle is in a first position and for providing a passive restraint for the child when the handle is in a second position. The carrier is removable from the carrier receiving support.

Implementations of the invention may include one or more of the following features. The seat provides a recess for receiving an end of the elongated member. The base includes a pair of pivot supports each including a positioning pin, and the carrier receiving support defines a corresponding plurality of slots having notches for receiving the positioning pins, the pins being slidable within the slots and receivable in the notches to restrict movement of the carrier receiving support relative to the base.

The seat includes upper and lower seat portions for receiving upper and lower portions of the child respectively, and the elongated member extends from the cross member substantially to the lower seat portion when the handle is in the second position. The elongated member extends substantially parallel to a length of the carrier when the handle is in the first position.

The carrier comprises a rib and the carrier receiving support defines a slot for receiving the rib. The rib is disposed on an exterior side surface of the seat, and a side wall of the carrier receiving support defines the slot.

The assembly further comprises a seat latch slidably coupled to the carrier receiving support and spring-biased toward the carrier. The seat defines a cavity for receiving a portion of the seat latch to inhibit separation of the carrier and carrier receiving support when the carrier is received by the carrier receiving support. The seat latch and carrier receiving support provide an indication of whether the seat latch is in a locked position. The seat latch and carrier receiving support provide indicia of whether the carrier is received by the carrier receiving support and, if so, whether the carrier is partially or fully received by the carrier receiving support.

At least one of the arms comprises a tab. The carrier includes a locking member nonrotatably coupled to the seat. The locking member has at least one engaging surface angled with respect to a handle pivot axis and disposed to interfere with the tab as the handle pivots to inhibit pivotal motion of the handle relative to the seat. The locking member is slidable relative to the seat to a first position where the tab and engaging surface interfere when the handle is pivoted and to a second position where the handle pivots substantially free of interference between the tab and the engaging surface.

The assembly further comprises a support member pivotally attached to a rear surface of the seat and adapted to support the seat in upright and reclining positions when the carrier is detached from the carrier receiving support. The support member comprises two substantially triangular-shaped walls and a coupling member coupled between the two walls, and the support device pivots relative to the seat about a support member pivot axis near a vertex of each of the walls.

In general, in another aspect, the invention features an infant carrier comprising a seat adapted to receive a child. A handle is pivotally attached to the seat and includes a pair of arms connected by a cross member and an extension depending from the cross member for carrying the carrier when the handle is in a first position and for providing a passive restraint for the child when the handle is in a second position.

Implementations of the invention may include one or more of the following features. An end of the extension opposite the cross member is disposed near a surface of a leg portion of the seat when the handle is in the second position. An end of the extension opposite the cross member is disposed within a recess in a surface of a leg portion of the seat when the handle is in the second position.

In general, in another aspect, the invention features an apparatus comprising a seat for holding a child, and a stabilizer pivotally attached to a rear surface of the seat and adapted to stabilize the seat in upright and reclining positions relative to a flat surface.

Implementations of the invention may include one or more of the following features. The stabilizer has a substantially triangular shape and is pivotally mounted to the seat near a vertex of the triangular shape. The stabilizer comprises a substantially hollow shell.

The apparatus further comprises a base including a receiving portion adapted to removably receive the seat, and a handle pivotally mounted to the seat, and the stabilizer is adapted to stabilize the seat in the upright and reclining positions when the seat is detached from the receiving portion.

In general, in another aspect, the invention features a chair and carrier assembly comprising a carrier including a seat for holding a child and a handle including a pair of arms pivotally mounted to the seat, at least one of the arms including a tab. A carrier receiving support is adapted to removably receive the carrier. A base is adapted to receive the carrier receiving support. The carrier defines a recess for receiving the tab, the recess being partially defined by a wall disposed at an angle relative to a pivot axis of the at least one arm, the wall inhibiting pivotal motion of the handle relative to the seat when the tab is received in the recess.

In general, in another aspect, the invention features a chair and carrier assembly comprising a carrier including a seat for holding a child and a handle including a pair of arms pivotally mounted to the seat and connected by a cross member. A base is adapted to be removably coupled to the carrier and to support the carrier above a flat surface. The carrier includes a pair of engaging surfaces configured to engage each other to inhibit pivoting of the handle while a torque applied to the handle relative to the carrier is less than a predetermined torque.

Implementations of the invention may include one or more of the following features. A first one of the arms is mounted to the seat to pivot about a pivot axis and includes one of the engaging surfaces, and the other one of the engaging surfaces is angled with respect to the pivot axis. The carrier includes a locking member nonrotatably coupled to the seat and slidable relative to the seat to a first relative position in which the pair of engaging surfaces can interfere when the handle is pivoted and to a second relative position in which the handle can pivot substantially free of interference between the pair of engaging surfaces. The locking member is slidable relative to the seat in a direction parallel to the pivot axis and is spring-biased into the first relative position. The first arm includes a tab and the locking member defines a plurality of radial notches for receiving the tab, a first one of the notches having walls substantially parallel to the pivot axis to substantially prevent pivoting of the handle when the tab is received by the first notch and a second one of the notches having the angled engaging surface. The second notch and the tab are disposed such that the cross member is disposed behind a rear surface of the seat when the tab is received by the second notch.

In general, in another aspect, the invention features a high chair comprising a plurality of legs. A carrier receiving support is coupled to at least a pair of the legs. A carrier is removably mounted to the carrier receiving support and includes a seat that defines a chamber for holding an infant, the chamber including an upper-body receiving portion and a lower-body receiving portion, the carrier further including a substantially U-shaped handle. The handle includes first and second arms connected by a cross member, the arms being pivotally mounted to the seat along a pivot axis, the first arm including an engaging tab. The handle further includes an elongated member extending from the cross member toward the lower-body receiving portion of the seat when the handle is in a first position and extending substantially parallel to a length of the seat when the handle is in a second position. The carrier defines a plurality of recesses, disposed about the pivot axis, for receiving the tab, a first one of the recesses being partially defined by a wall configured to interfere with the tab to permit pivotal motion of the handle relative to the seat when a loading of the handle exceeds a predetermined loading and the tab is received by the first recess.

Implementations of the invention may include one or more of the following features. The high chair further comprises a stabilizer pivotally mounted to a rear surface of the seat for supporting the seat in upright and reclining positions, relative to a flat surface, when separated from the carrier receiving support.

Various embodiments of the invention may provide one or more of the following advantages.

As provided, the chair may be advantageously adjusted to meet the needs of a growing child.

The invention has the advantage that it is easily assembled.

The invention has the additional advantage of not requiring purchase of both a child carrier and an adjustable-height chair.

The invention has the additional advantage of providing a carrier that is easily attached to and removed from an adjustable-height chair assembly without having to remove the child from the carrier.

The invention has the additional advantage of a pivoting U-shaped handle that serves as both a convenient carrying handle and a passive restraint for the child in the carrier. The invention allows the passive restraint to be movable while guarding against pinching dangers.

The invention has the further advantage of a stable structure to prevent the carrier from rocking or tipping over when used separately from the base.

The invention also provides a high chair that is stable and can withstand significant forces on various parts of the high chair without tipping over and can automatically compensate for at least some undesired forces.

Other features and advantages of the invention will become apparent from the following detailed description, and from the claims.

DESCRIPTION OF THE PREFERRED EMBODIMENTS

Figure 1:
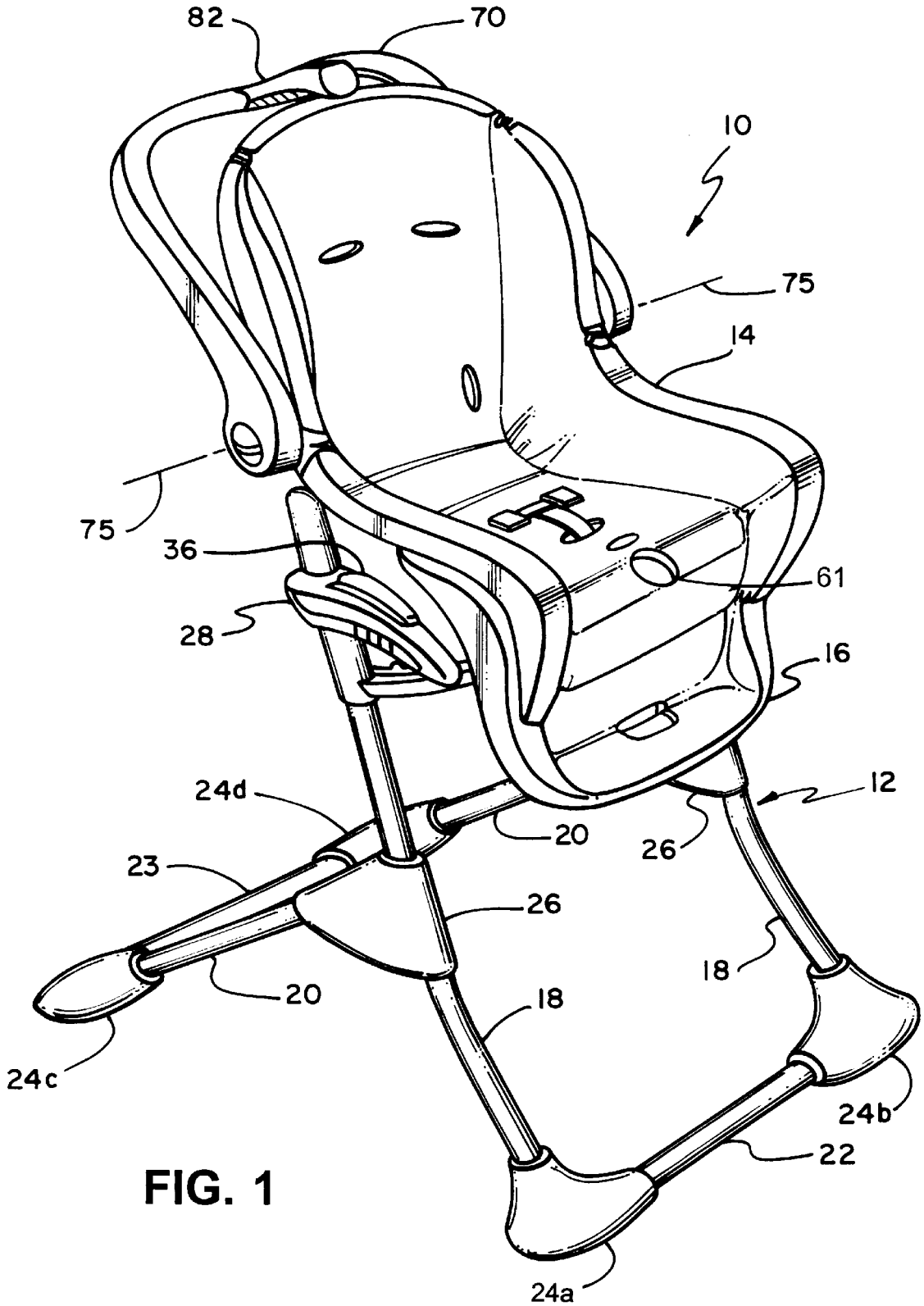
FIG. 1 is a perspective view of an assembled chair and carrier according to the invention.
Figure 2:
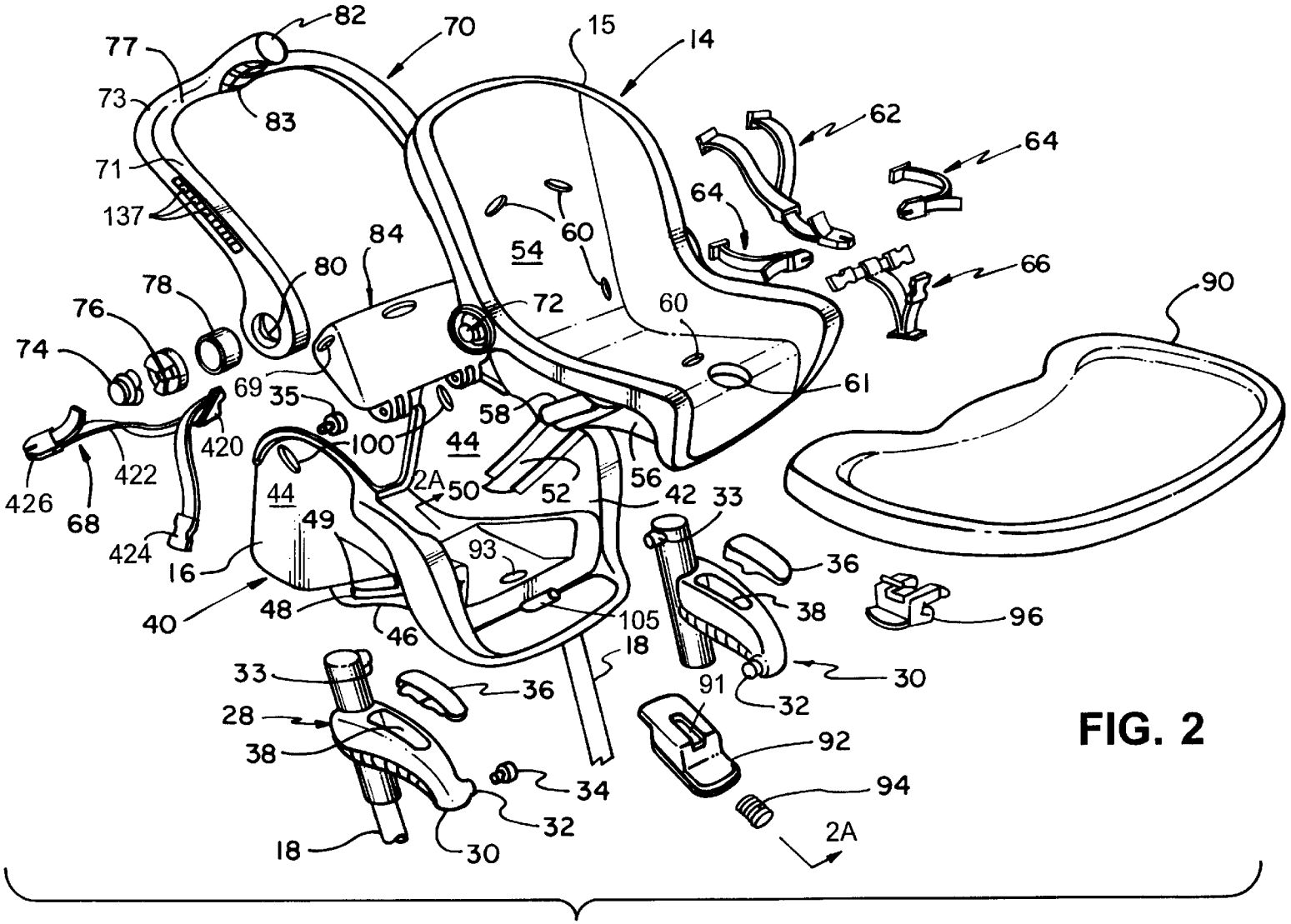
FIG. 2 is a partial exploded view of the chair and carrier shown in FIG. 1.

FIGS. 1 and 2 illustrate one embodiment of the invention as a chair and carrier assembly 10 comprising a base 12, a carrier 14 and a carrier receiving support 16. Carrier 14 is removable from carrier receiving support 16 to function as a booster seat or as a portable infant carrier.

Base 12 includes front tubular legs 18, rear tubular legs 20 and horizontal tubular supports 22 and 23 extending, respectively, between front legs 18, 18 and rear legs 20, 20. Front tubular legs 18 and rear tubular legs 20 are angled with respect to each other to form a stable supporting structure. Base 12 also includes feet 24*a*–24*d* connected to legs 18, 18 and 20, 20 at the junction of supports 22 and 23 to assist in maintaining the shape of base 12 at the junctions of the tubular pieces 18 and 20 with 22 and 23, respectively. Base 12 also includes leg collars 26 to which legs 20 are pivotally coupled (as more fully described below with respect to FIG. 12 in relation to the embodiment shown therein). Leg collars 26 permit rear tubular legs 20 to be folded inward toward front tubular legs 18 for storage or transport of the base. Feet 24*a*–24*d* support base 12 on a horizontal surface such as the floor.

Tubular portions 18, 20, 22, and 23 are made of metal (e.g., steel) and feet 24*a*–24*d* and leg collars 26 may be made from any rigid material, preferably a hard plastic (e.g., polypropylene), metal or a combination of both. Further, tubular portions 18, 20, 22, and 23 may be either hollow or solid. Feet 24*a*–24*d* may also have rubberized or rough lower surfaces to prevent slippage of assembly 10 on the floor.

Legs 18 extend above leg collars 26 and pivot supports 28 are slidably mounted to the upper ends of front tubular legs 18 for height adjustment. Front tubular legs 18 extend within pivot supports 28. Each pivot support 28 includes a forwardly projecting supporting arm 30 and protrusions 32 and 33 (FIG. 2). Protrusion 32 securely mates with pivot bushing 34, e.g., by threading, and protrusion 33 securely mates with nut 35, e.g., by threading as well.

Each pivot support 28 also includes a height adjust button 36, which fits within recess 38 in supporting arm 30. Pivot support 28 is prevented from sliding downward along front tubular leg 18 by a spring loaded lever that falls into one of a plurality of corresponding holes in front tubular leg 18 (as more fully described below with respect to FIG. 12 in relation to the embodiment shown therein). Height adjust button 36 is depressed to adjust the height of pivot support 28 with respect to the ground by releasing the spring loaded lever to allow pivot support 28 to move along the length of front tubular leg 18.

Carrier receiving support 16 is pivotally connected to pivot supports 28 so that it may recline for young children. Carrier receiving support 16 is preferably a unitary injection molded piece of hard plastic material, e.g., polypropylene. Carrier receiving support 16 has an exterior bottom portion 40 and an interior upper surface 42 including side walls 44. The interior side walls 44 contain guide protrusions 50 which form a linear sliding region 52. The interior side walls also include elongated sliding pivot holes 100.

Carrier receiving support 16 also has lower flanges 46 (only one shown in FIG. 2) projecting orthogonally outwardly from exterior bottom portion 40. Each flange 46 includes an elongated slotted portion 48, with a plurality of enlarged notches 49 along its length (better shown in FIGS. 5–7).

Carrier 14 is shaped to be received within interior upper surface 42 of carrier receiving support 16 between interior side walls 44. Carrier 14 includes a seat 15 having a seat portion 54 for holding a child and that is preferably a unitary molded component. Seat 15 also has a bottom surface 56 which engages with carrier receiving support 16. Bottom surface 56 has a protruding tongue 58 on each side (only one shown in FIG. 2) shaped to slide into linear sliding region 52 formed by guide protrusions 50 (only two of four shown in FIG. 2) on interior side walls 44 of carrier receiving support 16. The carrier 14 can be locked into place in the carrier receiving support 16.

Figure 2A:
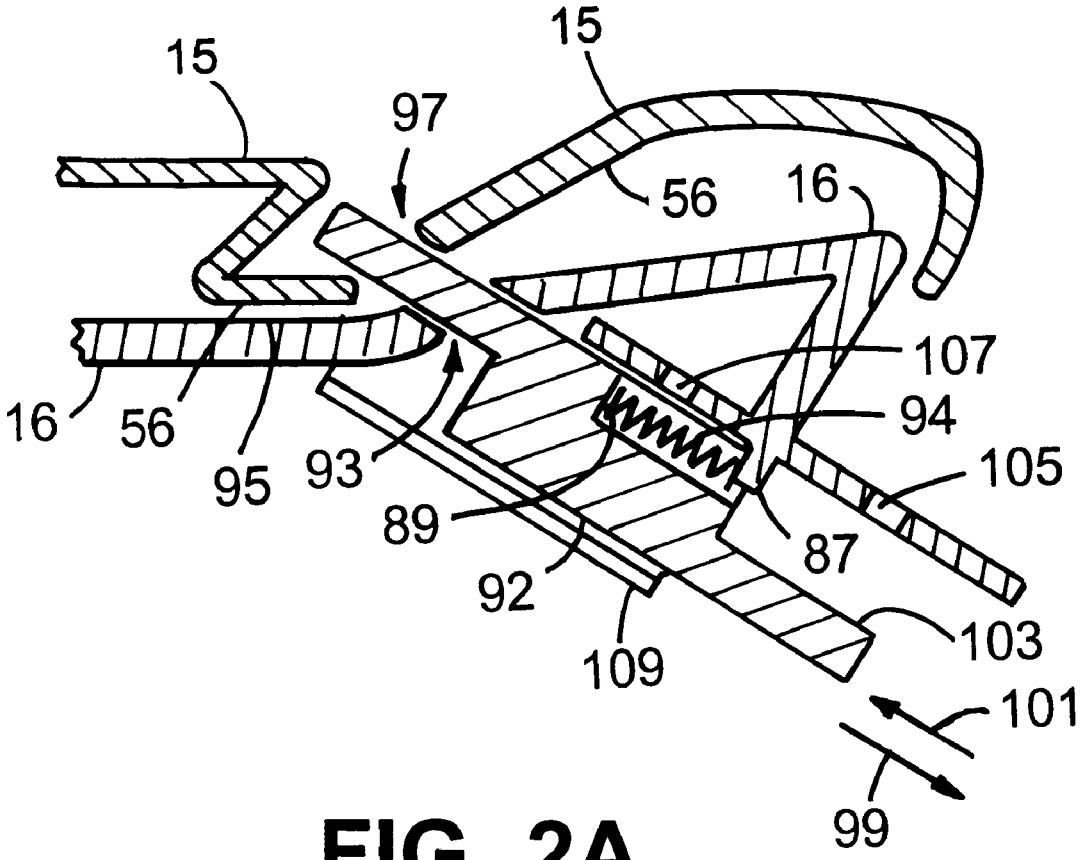
FIG. 2A is a partial cross-sectional view of the assembled chair and carrier shown in FIG. 1 taken generally along line 2A—2A in FIG. 2.

To lock the carrier 14 into the carrier receiving support 16, a seat latch 92 and compression spring 94 are mounted onto the bottom side of the lower portion of carrier receiving support 16. As further shown in FIG. 2A, seat latch 92 together with compression spring 94 act as a spring loaded clip mechanism for locking carrier 14 in place when carrier 14 is being placed onto carrier support member 16. Spring 94 is disposed between an end 89 of slot 91 and a post 87 depending from the bottom of support 16. Seat latch 92 is thus spring biased through a hole 93 in support 16 in direction 101. Hole 93 provides a guide to seat latch 92. A rib 107 and two retaining clips 109 (only one of which is shown in FIG. 2A) on either side of seat latch 92 that slidably clip to seat latch 92 help keep seat latch 92 in place while permitting seat latch 92 to slide relative to carrier receiving support 16.

When carrier 14 is slid into place on carrier receiving support 16, a portion 95 of bottom surface 56 of seat 15 makes contact with the seat latch 92 to push it out of the path of movement of the seat 15 in direction 99. When an opening 97 on the bottom of seat 15 reaches seat latch 92, the latch 92 snaps into the opening 97, in direction 101, due to the force of the compressed spring 94. To release carrier 14 for removal from carrier receiving support 16, seat latch 92 is pulled out of the opening 93 in direction 101. When carrier 14 is removed and seat latch 92 is released, spring 94 causes seat latch 92 to move in direction 99. A top surface 103 of seat latch 92 shows through a slot 105 in support 16. Markings on top surface 103 visible through slot 105 indicate whether seat 15 is present, and if so, whether seat 15, and thus carrier 14, is locked into place with carrier receiving support 16, as described more fully below with respect to FIG. 23 and the embodiment of the invention shown therein.

Seat portion 54 may include holes 60 for attaching shoulder strap 62, waist straps 64, and crotch strap 66 that fastens to waist straps 64, all of which help to retain the child in the seat portion 54. Seat portion 54 may also receive or include a seat cushion (not shown).

A U-shaped handle 70 of carrier 14 is a bail with side arms 71 and a cross member 73. Handle 70 is pivotally attached to seat 15 by connectors 72 located on the sides of the seat 15. Handle 70 pivots around connectors 72 about a pivot axis 75 (FIG. 1) over the seat portion 54 and is locked in only a fixed number of angular positions, including behind seat 15. To accomplish this pivoting, handle 70 is attached to connector 72 with handle locking button 74, handle locking disk 76 and handle locking hub 78, all of carrier 14, through a hole 80 in handle 70. Hub 78 fits in hole 80 of handle 70 to provide structure within hole 80. Button 74, disk 76, hub 78 in combination with handle 70, and connector 72 are configured and operate similar to another embodiment of the invention shown in FIGS. 14–16 and described more fully with respect thereto. The embodiment shown in FIG. 2, however, does not include the "breakaway" feature of the embodiment shown in FIGS. 14–16 and described below.

Handle 70 may be rotated over the head and body of a child placed in seat 15 to be positioned in front of the child to serve as a support for a tray 90. Tray release levers 96 attached to the underside of tray 90 are spaced to snap into recesses 137 in arms 71 to snap tray 90 into place on handle 70 when the handle 70 is pushed to the forward horizontal position. Tray release levers 96 may be pressed to remove tray 90 from handle 70.

Figure 3:
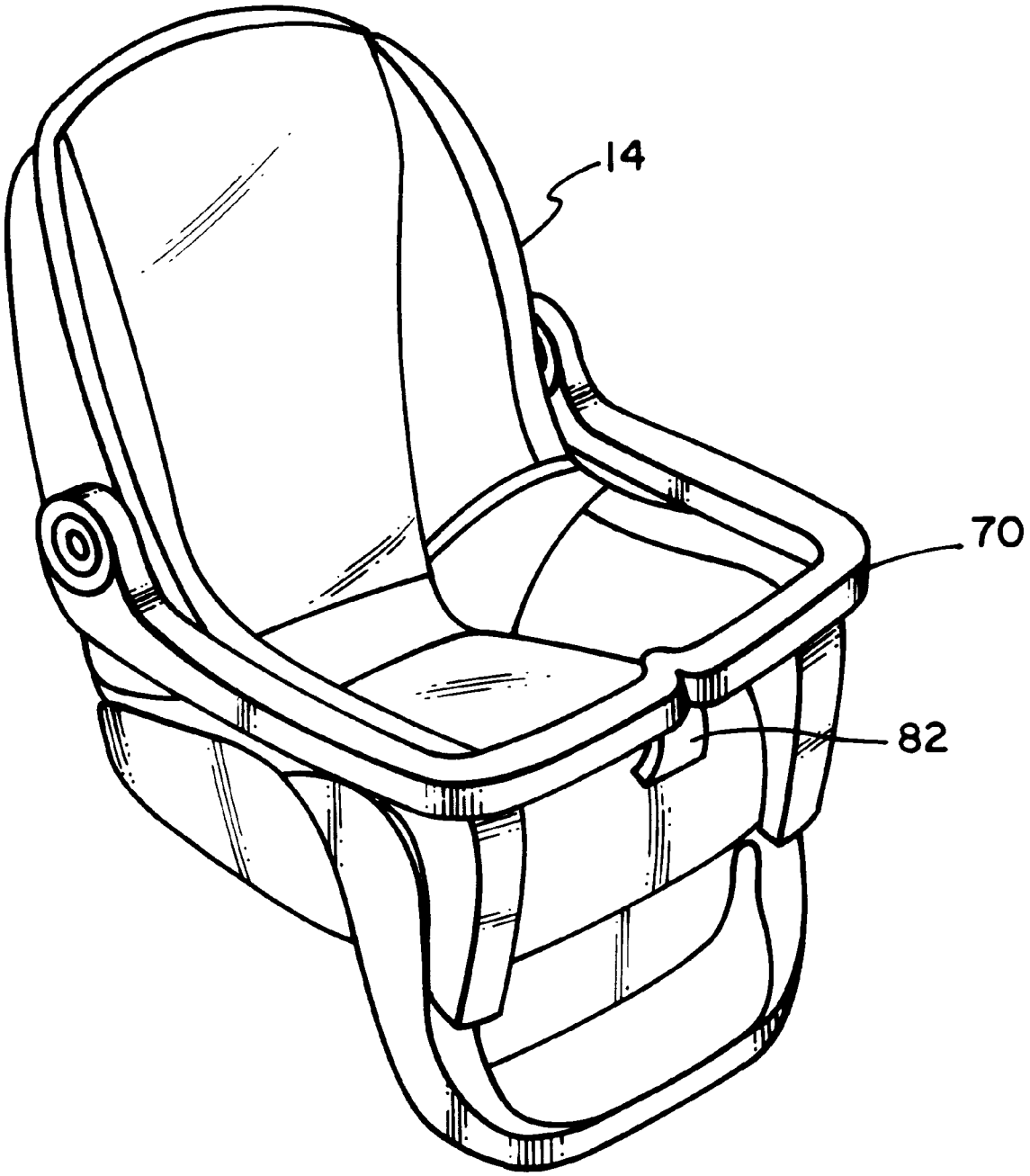
FIG. 3 is a perspective view of a carrier and carrier receiving support shown in FIG. 1.

Seat 15 and handle 70 cooperate to provide both an adjustable-height chair and a reclining infant carrier. Handle 70 also has a passive restraint hand grip extension 82. Extension 82 extends from cross member 73 of handle 70 inwardly toward pivot axis 75 and away from a bottom surface 77 of handle 70. Handle 70 can be positioned in front of a child placed in carrier 14 to provide a support for tray 90 such that extension 82 extends between the child's legs to a front edge, or into a recess 61 in the front edge, of the seat 15 to provide a passive restraint to help to restrain the child in the carrier 14. The configuration with extension 82 in recess 61 is shown in FIG. 3.

Figure 4:
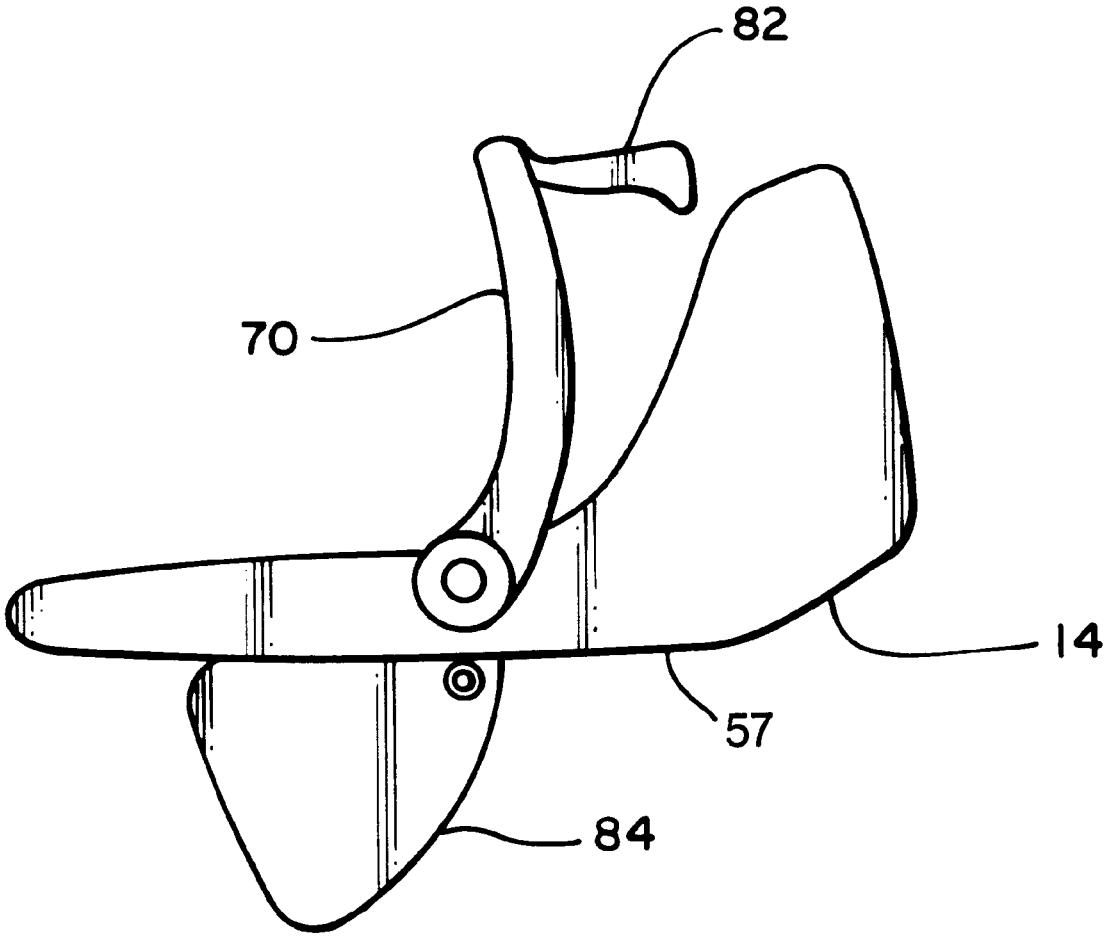
FIG. 4 is a side view of the carrier, shown in FIG. 1, in a position for carrying a child.

As shown in FIG. 4, extension 82 also functions as a carrier handle when carrier 14 is used separately from base 12 as a child carrier. Extension 82 may also include handgrip 83 (FIG. 2) for easy gripping by a person carrying carrier 14. In the position shown in FIG. 4, extension 82 is generally parallel to the length of the carrier 14 for ease of carrying.

A triangular-shaped support member 84 of carrier 14 is pivotally attached to a back surface 57 of seat 15. As shown, support member 84 is hollow. Especially when placed in the upper position (FIGS. 5–7) against the back of seat 15, support member 84 may be used as a storage bin. The support member 84 may be fully enclosed and may have one or more hinges on one of its edges. When placed in the lower position (FIG. 9) orthogonally to bottom portion 56, support member 84 may be used to support carrier 14 in an upright position with respect to a horizontal surface. With support member 84 in the upper position, carrier 14 will be unstable if in the upright position when separated from carrier receiving support 16 and placed on a flat surface with no other support.

A slot 69 in triangular-shaped support member 84 is provided for receiving a clip 420 of a booster seat strap 68. Clip 420 is fixedly attached, e.g., by sewing, along a length of a webbing 422, as is a female fastener 424 to one end of webbing or mesh member 422 (e.g., woven nylon or polypropylene). A male fastener 426 is adjustably coupled near the other end of webbing 422 so that fastener 426 can be moved along the length of webbing 422. The fasteners 424 and 426 can be, e.g., VALCO® snap buttons (made by VALCO® Valley Tool & Die, Inc., 10020 York Theta Drive, Cleveland, Ohio 44133-3535) and can be connected around part of a chair (not shown), and male fastener 426 adjusted, to help secure assembly 10 to the chair. A similar slot 69 and booster seat strap 68 are provided at the other end of member 84, although neither are shown in FIG. 2.

Triangular support member 84 may be locked in place in either the upper or lower position using tab and slot connectors (e.g., as more fully described below with respect to FIG. 11 in relation to the embodiment shown therein). Triangular support member 84 may be easily unlocked from either locked position, e.g., by removing the tabs from the respective slots.

To assemble assembly 10, carrier receiving support 16 is attached to base 12. Protrusions 32 are mated with pivot bushings 34 through elongated slotted portion 48. Similarly, protrusions 33 are mated with nuts 35 through sliding pivot holes 100.

In use, carrier 14 is placed on carrier receiving support 16 by aligning protruding tongue 58 on the seat 15 in the linear sliding region 52 formed on the interior side walls 44 of the carrier receiving support 16. As the carrier 14 slides into place, it automatically locks onto the carrier receiving support 16 by the action of the seat latch 92 as described above. The carrier 14 is removed from the carrier receiving support 16 simply by pulling on the seat latch 92 to release the carrier 14 and lifting the carrier 14 out of the carrier receiving support 16 along the linear sliding region 52.

Figure 5:
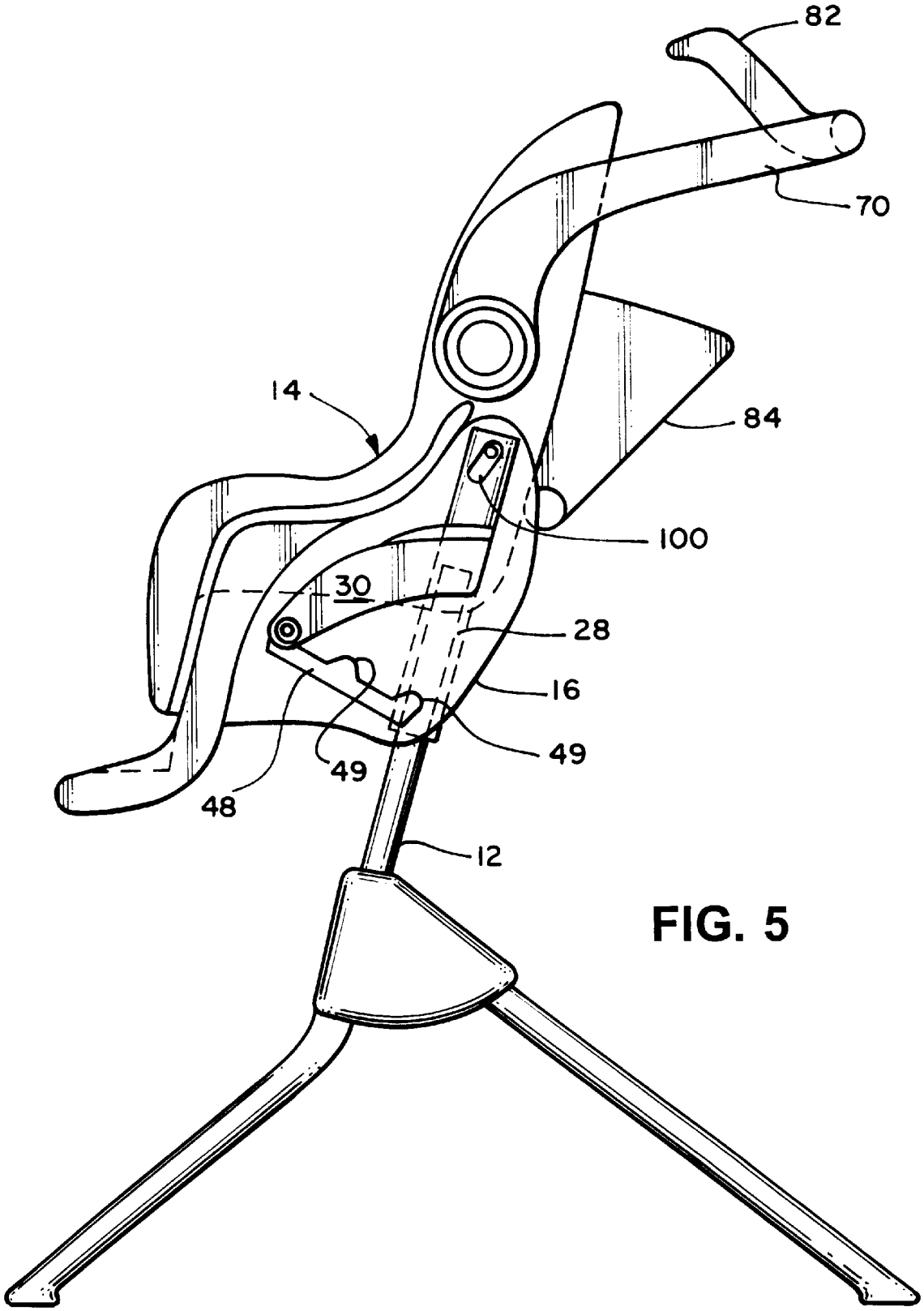
FIG. 5 is a side view of an assembled chair and carrier in an upright position.
Figure 6:
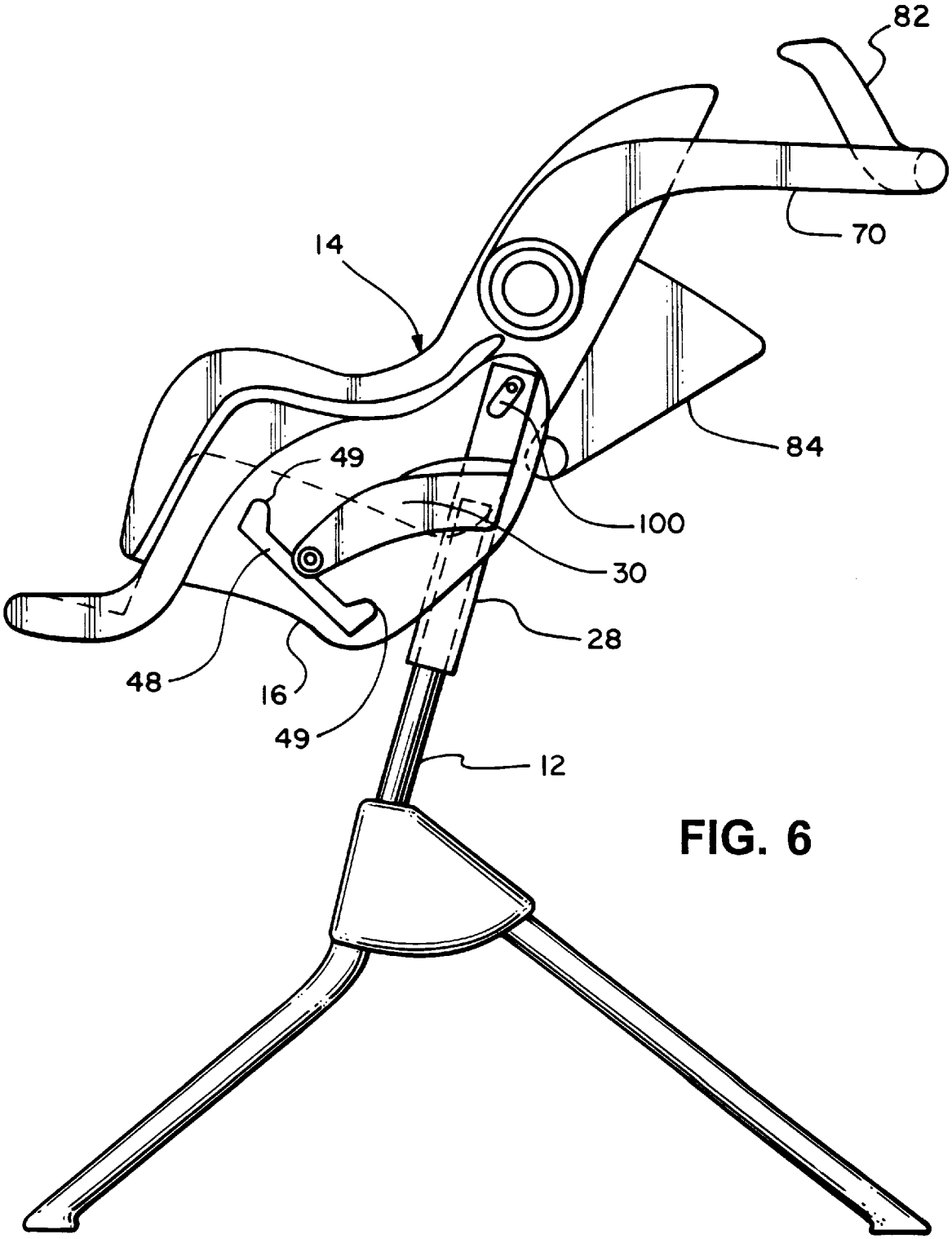
FIG. 6 is a side view of an assembled chair and carrier in a partially reclined position.
Figure 7:
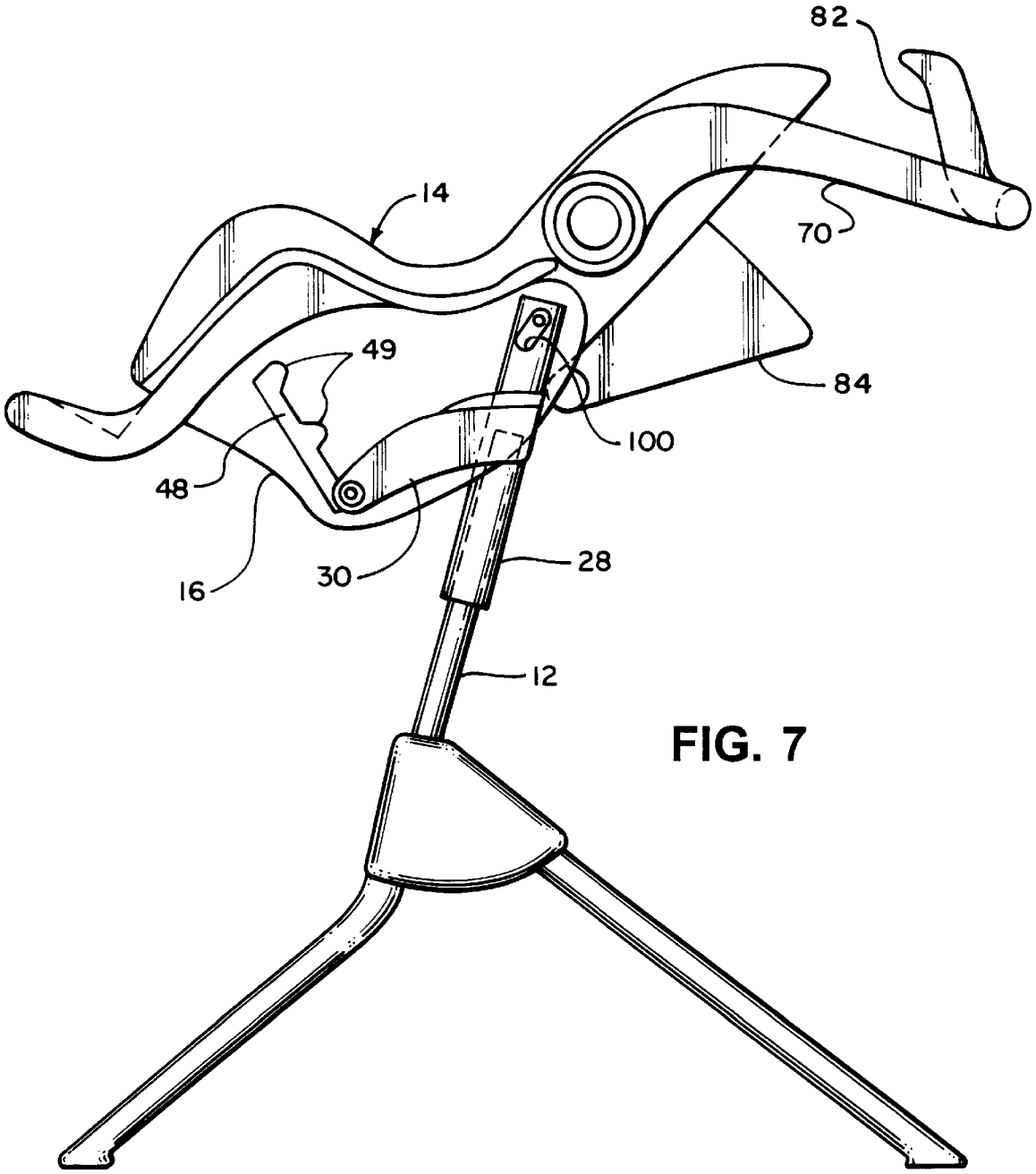
FIG. 7 is a side view of an assembled chair and carrier in a fully reclined position.

The reclining angle of the carrier 14 may be changed when carrier 14 is placed in carrier receiving support 16. To recline the carrier 14, the carrier receiving support 16 is lifted slightly and moved forward or back to rest in notched portions 49 along elongated slot 48. To accommodate the slight lifting movement, the protrusion 33 slides up and down within the sliding pivot hole 100. FIGS. 5, 6 and 7 show three different reclining positions that may be achieved using this mechanism, namely upright, partially reclining and fully reclining.

Figure 8:
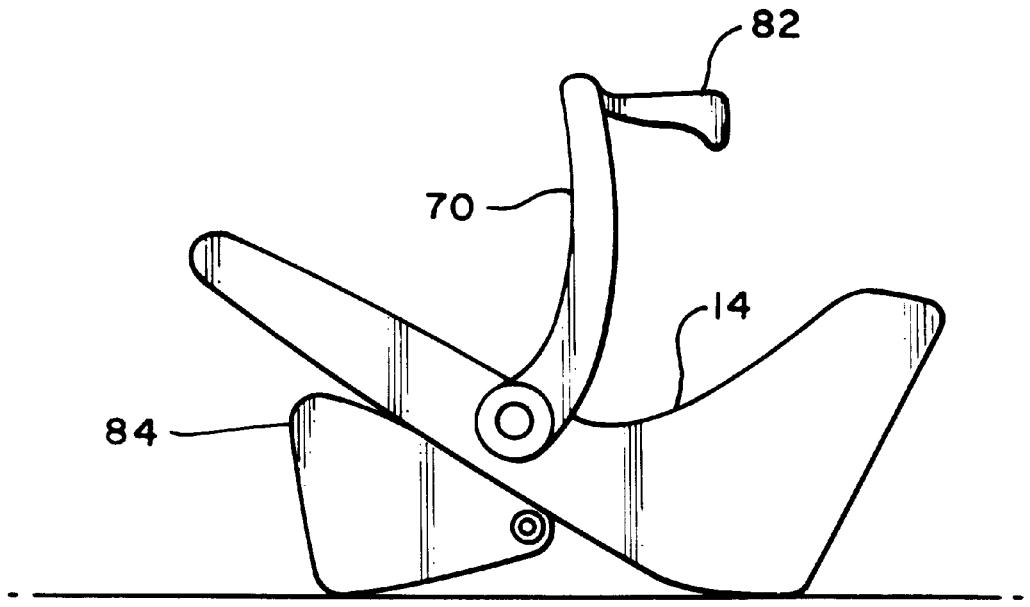
FIG. 8 is a side view of a carrier in a reclined position on a flat surface.
Figure 9:
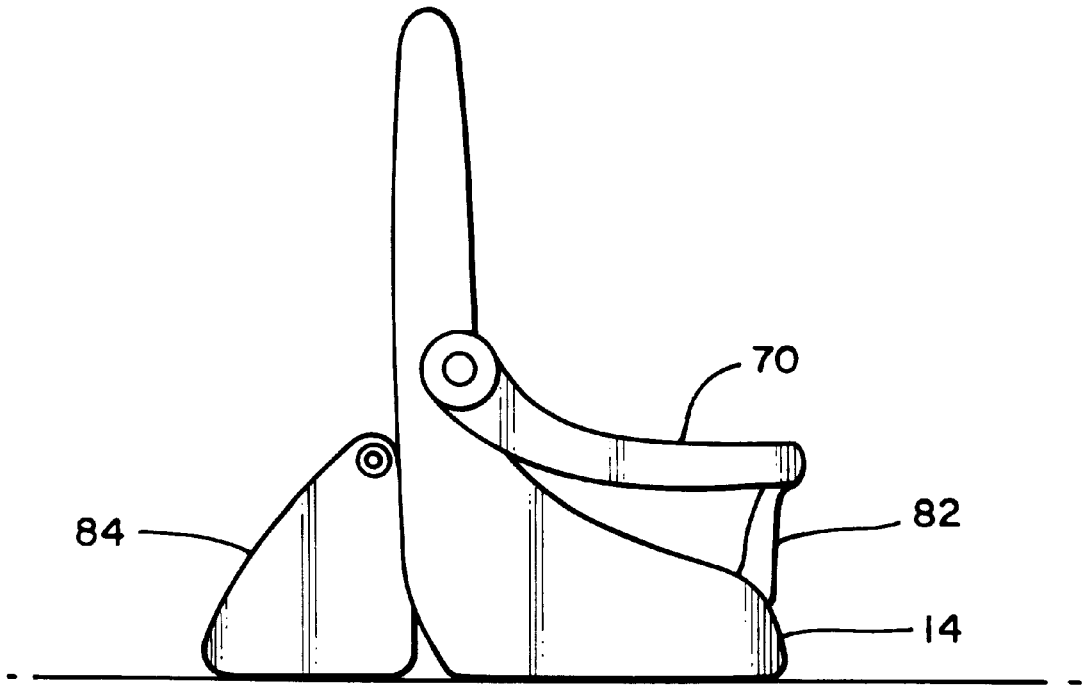
FIG. 9 is a side view of a carrier in an upright position of flat surface.

As discussed above, carrier 14 may be used separately from base 12 and carrier receiving support 16. For example, FIGS. 8 and 9 show carrier 14 placed in both the reclining and upright positions on a horizontal surface, respectively, using triangular support 84 in upper and lower positions, respectively, to maintain the positions of carrier 14.

Figure 10:
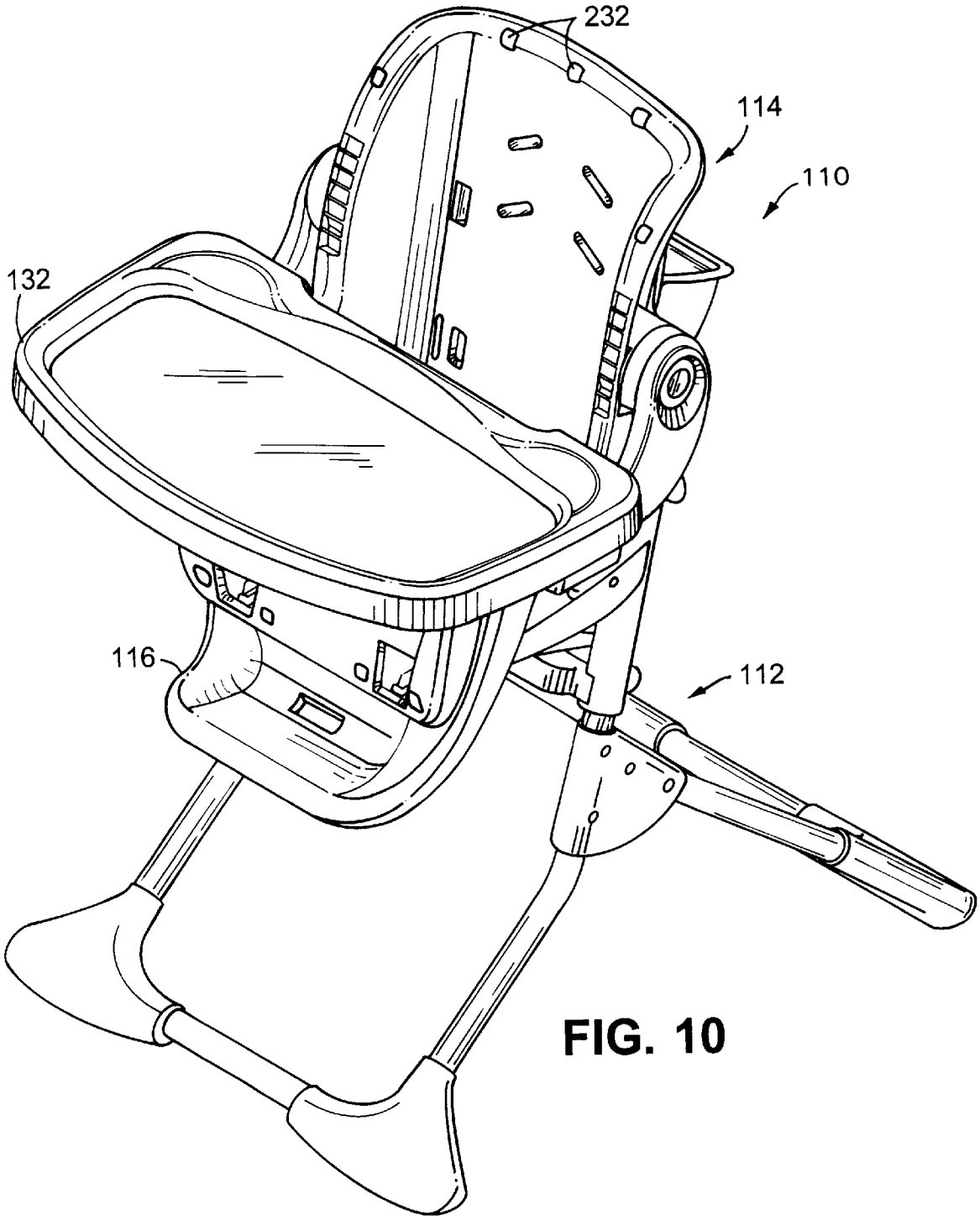
FIG. 10 is a front perspective view of another embodiment of an assembled chair and carrier.

Another embodiment of the invention is shown in FIGS. 10–27. As shown in FIGS. 10–12, a high chair and carrier assembly 110 includes a base 112, a carrier 114, a tray 132, and a carriage or carrier receiving support 116. Carrier 114, tray 132, and carrier receiving support 116 are made primarily of an injection molded copolymer such as polypropylene. Legs 348 of base 112 are made of metal, e.g., steel.

Referring to FIG. 12, carrier 114 includes a handle 118 a seat 120, and a basket 122. Carrier 114 is adapted to receive a child comfortably and to be received by carrier receiving support 116. When removed from receiving support 116, carrier 114 can be used to transport a child and when received by receiving support 116 can serve as the seat portion of a high chair.

Seat 120 includes side walls 146, a backrest 208, an upper leg portion 210, and a lower leg portion 212. These portions of seat 120 define a chamber 214 for comfortably receiving a child. Backrest 208 has several strap openings 216, 218, and 220 (only one is shown in FIG. 12) for receiving shoulder straps and waist straps (FIG. 2) for securing the child into chamber 214. These straps are respectively secured to the back and bottom of seat 120. Two sets of strap openings 216 and 218 are provided to permit adjustability of the shoulder straps to accommodate children of different sizes. Upper leg portion 210 has an opening 222 for receiving a crotch strap (FIG. 2) that is attached to the bottom of seat 120 and extends up through the child's legs. Upper leg portion 210 also has two slots 224 (one shown), for receiving portions of a seat latch (described below), and a circular recess 226 for receiving a portion of a handle (described below). Disposed about a periphery of seat 120 are a plurality of clips 119 (FIG. 11) on the back side of seat 120 for attaching a cushion (not shown) to seat 120 in chamber 214. The clips 119 correspond to a plurality of recesses 232 that appear on the front side of seat 120 that help ensure that the material thickness of seat 120 is consistent throughout.

Figure 17:
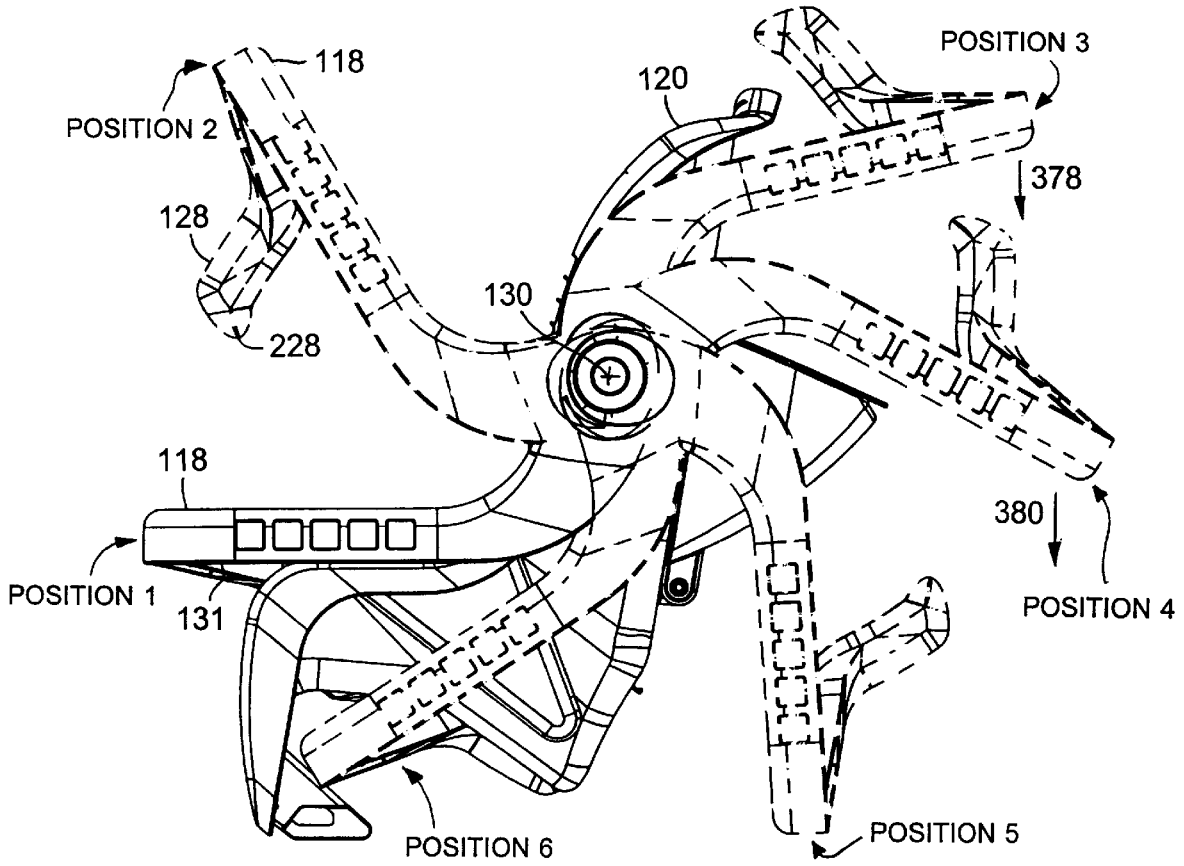
FIG. 17 is a side view of the carrier shown in FIG. 10 with a handle in six different angular positions, five of the positions being shown in broken lines.

Referring also to FIG. 17, handle 118 is substantially U-shaped and includes arms 124, a cross member 126, and an extension 128. Extension 128 extends from cross member 126 inwardly toward a pivot axis 130 and away from a bottom surface 131 of cross member 126. Extension 128 is adapted to be grasped by a person for use as a carrier handle in order to carry the carrier 114. To make extension 128 as a unitary piece as shown, it is made using a gas-assist molding process (an injection molding process where gas is injected into liquid plastic to fill a portion of the mold to produce hollow portions in the finished piece). An end portion 228 of extension 128 of handle 118 fits within recess 226 in upper leg portion 210 of seat 120.

Figure 12:
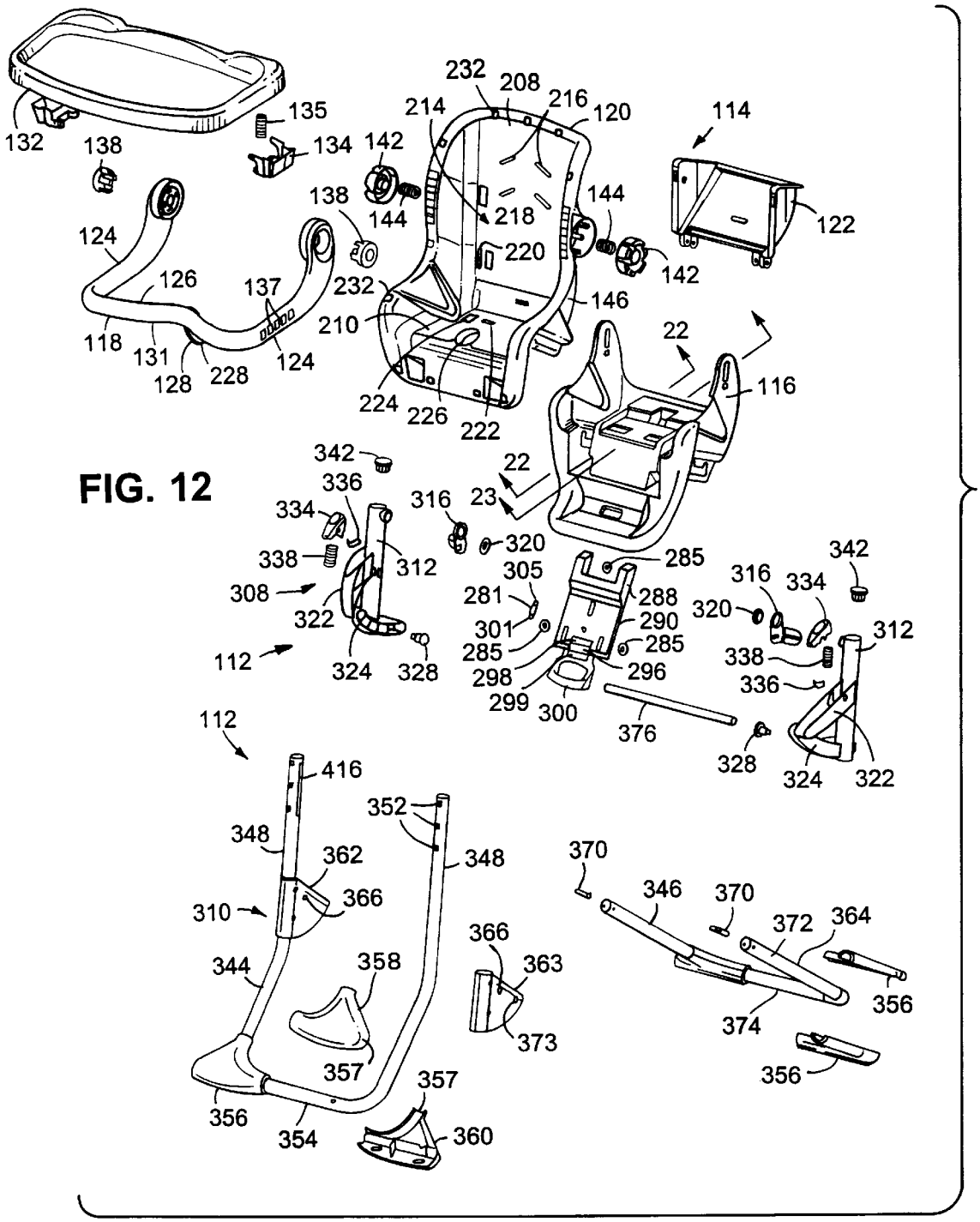
FIG. 12 is an exploded view of the chair and carrier shown in FIG. 10.
Figure 13A:
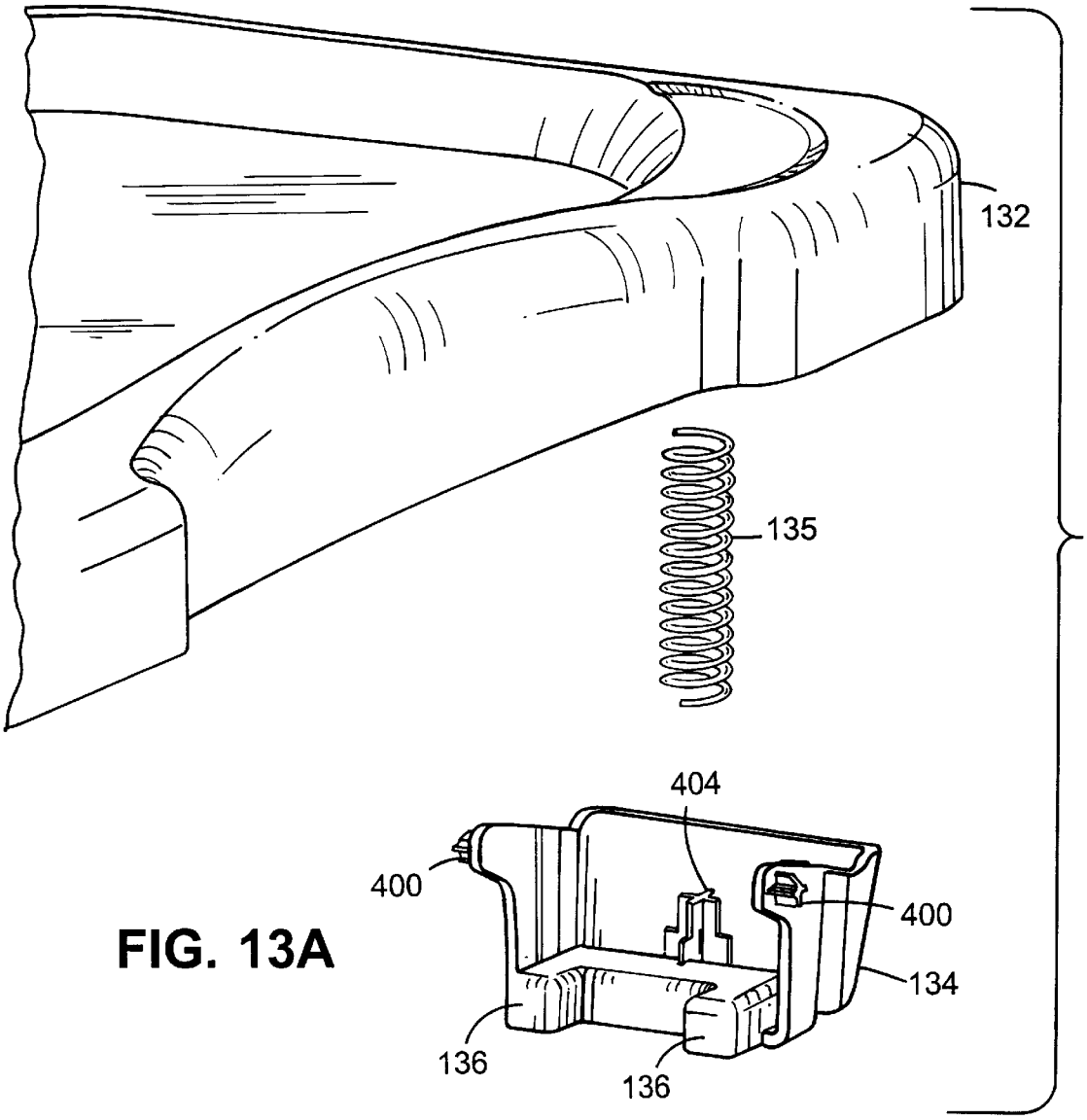
FIGS. 13A–13B are exploded views of a tray, tray latch, and spring.
Figure 13B:
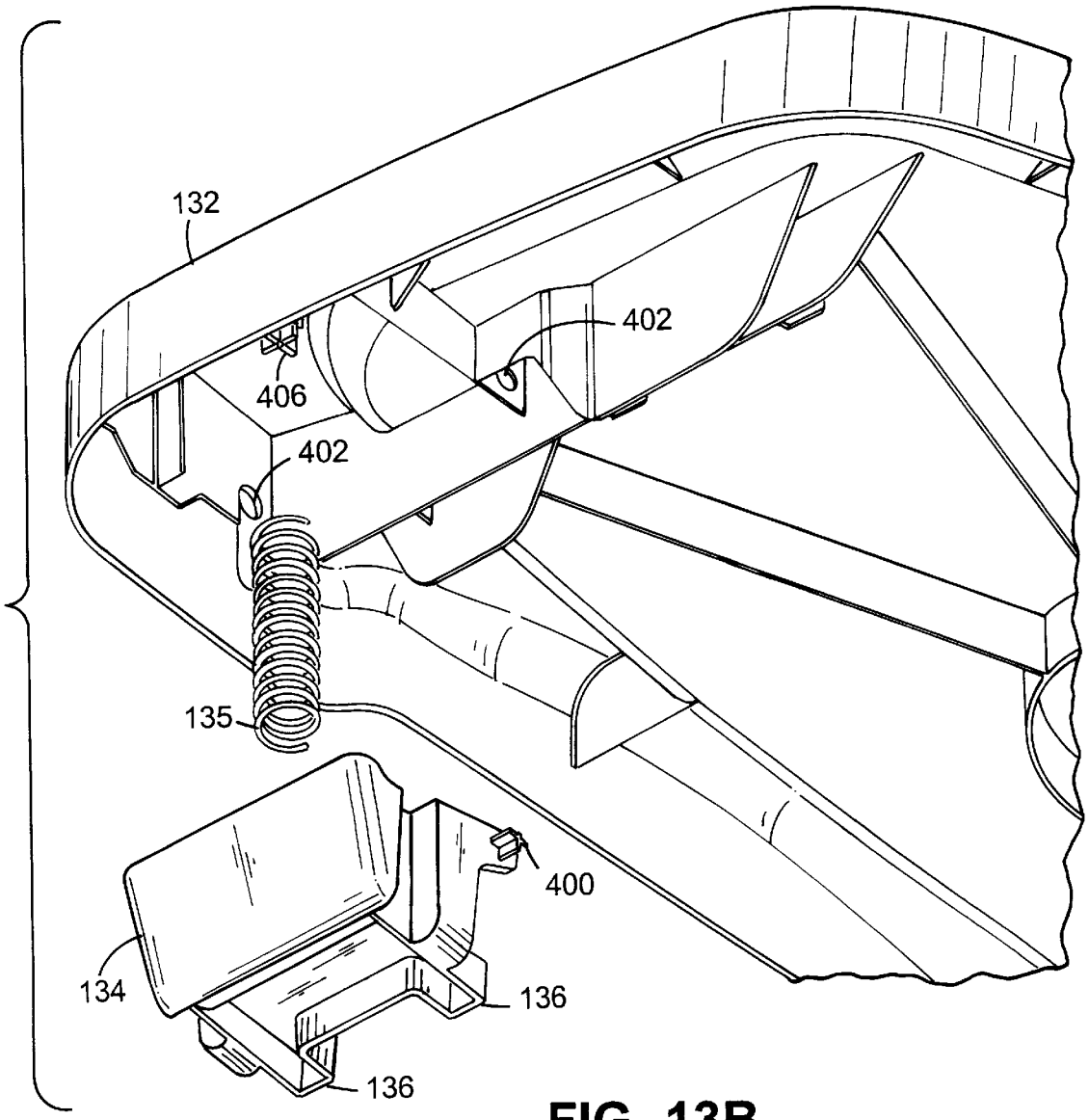

Referring to FIGS. 12 and 13A–13B, handle 118 and tray 132 are configured to mate such that tray 132 rests on arms 124 and cross member 126. Two posts 400 of each of two tray latches 134 (only one is shown in FIGS. 13A–13B) are rotatably received by holes 402 in tray 132 to pivotally attach each latch 134 to the underside of the tray 132. A compression spring 135 is slidably received by a post 404 of latch 134 and by a similar post 406 of tray 132. Spring 135 spring biases latch 134 to pivot inwardly about posts 400 toward the center of tray 132. Each latch 134 has two prongs 136 that are configured to fit within two recesses 137 of five recesses 137 in arms 124 (recesses 137 in only one of arms 124 are shown in FIG. 12). The two recesses 137 into which prongs 136 fit are separated by one recess 137 such that tray latches 134 can be received by recesses 137 in three positions along the lengths of arms 124.

Tray 132 is attached and removed from handle 118 using tray latches 134. To mount tray 132 on handle 118, tray latches 134 are rotated outward about posts 400 against the spring bias of springs 135. Tray 132 is positioned onto handle 118 such that prongs 136 are aligned with recesses 137 in arms 124. Tray latches 134 are released so that the spring biases of springs 135 force prongs 136 into two of the five recesses 137. To release tray 132, one of tray latches 134 is rotated outward about posts 400 until prongs 136 are no longer received by recesses 137 in the corresponding arm 124. The edge of tray 132 with the released tray latch 134 is lifted to rotate tray 132 to remove prongs 136 of the other tray latch 134 from recesses 137 in the other arm 124. Alternatively, both tray latches 134 can be rotated until prongs 136 are removed from recesses 137 in both arms 124, and tray 132 separated from handle 118. Tray 132 can be moved so that prongs 136 align with different recesses 137, and tray latches released to allow recesses 137 to receive prongs 136.

Referring to FIG. 12, in carrier 114, handle 118 is pivotally coupled to seat 120 to permit handle 118 to be pivoted into a fixed number of angular positions relative to seat 120. As shown in more detail in FIGS. 14–16, handle 118 is coupled to seat 120 with a pivot assembly 139 (with a mirror image assembly provided for the other arm 124) of carrier 114. Each pivot assembly 139 includes a button 138, a screw 140, a locking disk 142, and a spring 144.

Figure 14:
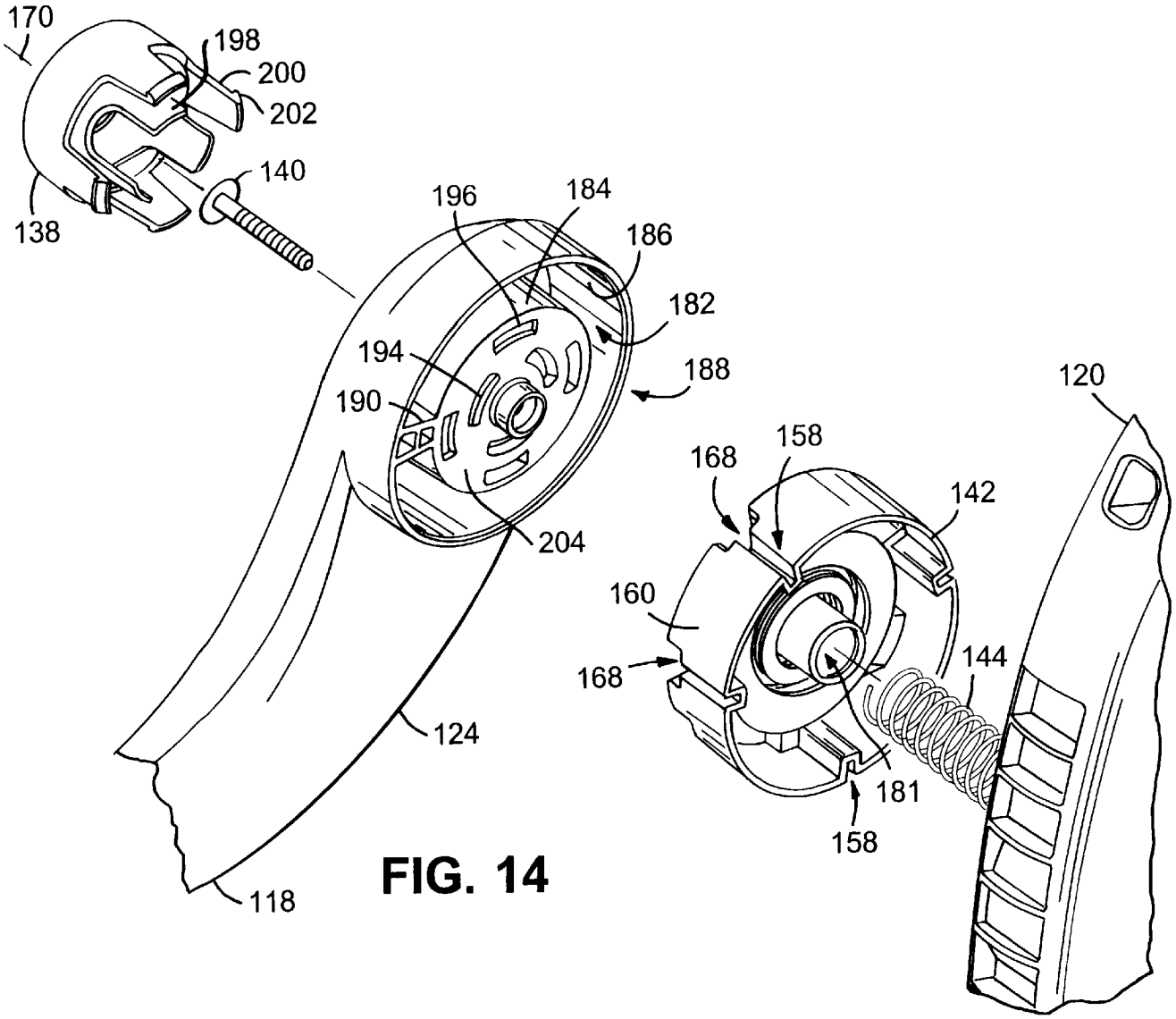
FIGS. 14–15 are exploded views of a selectively pivotable assembly of a handle and a seat of the carrier shown in FIG. 10.
Figure 15:
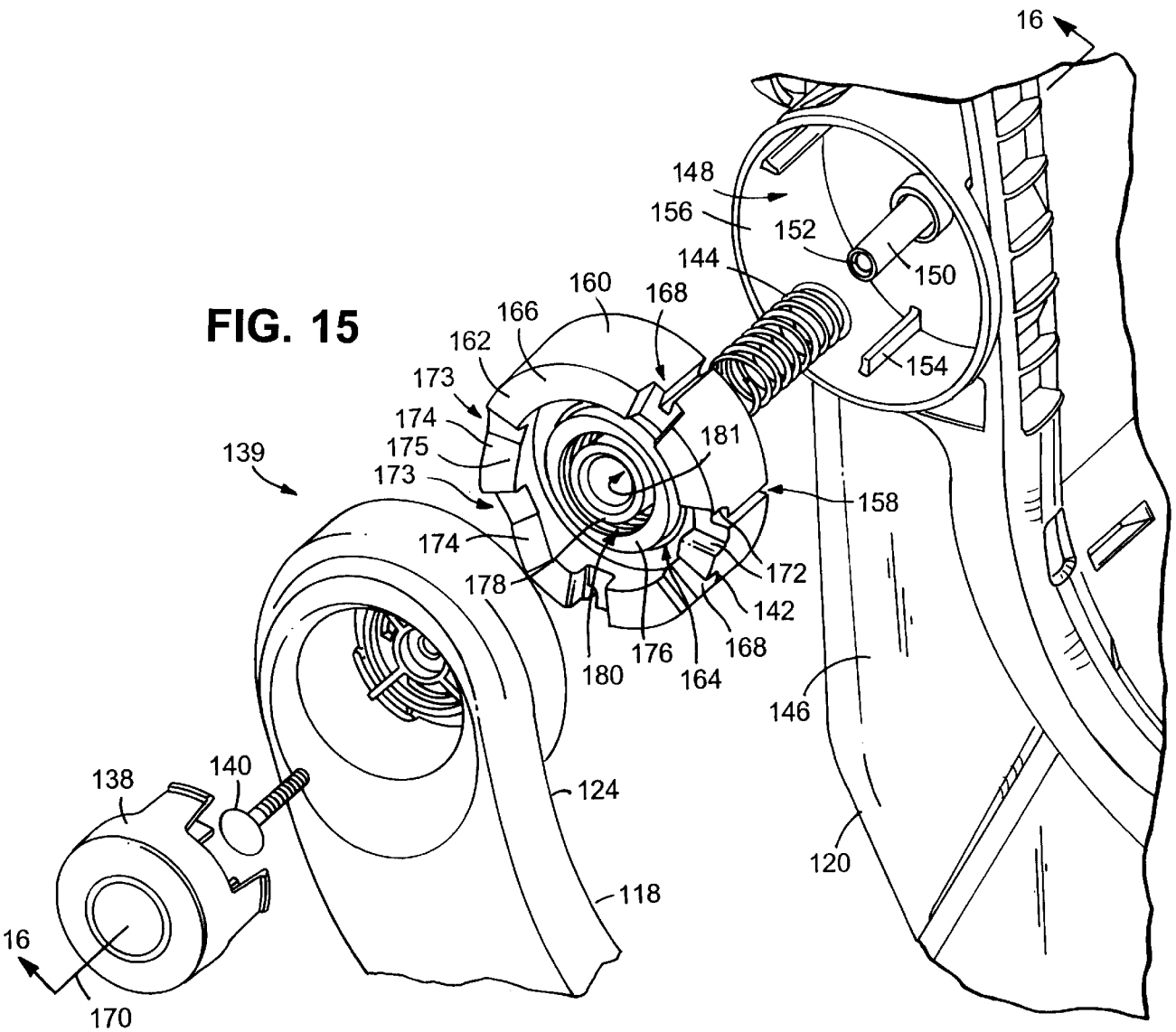
Figure 16:
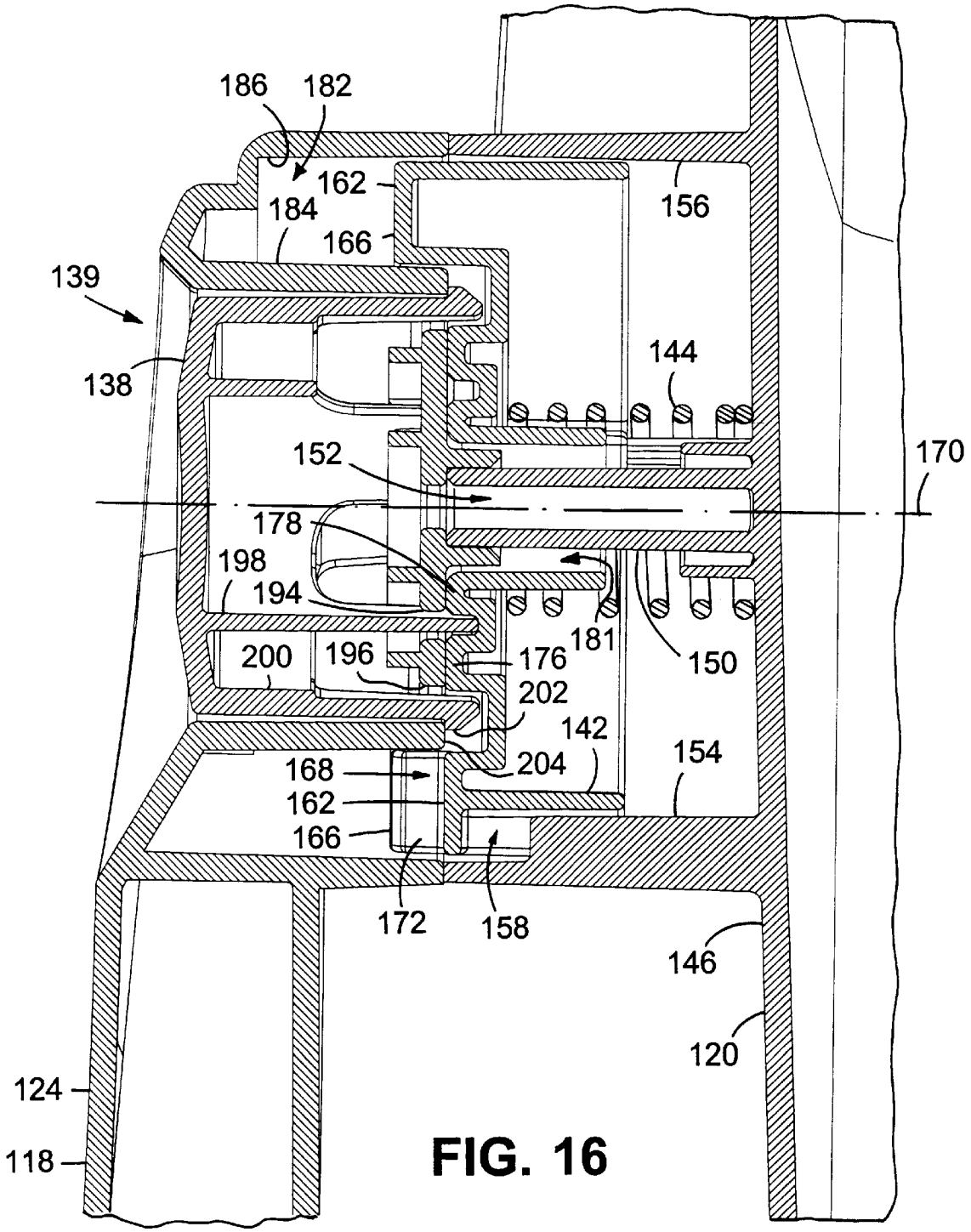
FIG. 16 is a cross-sectional view of the assembly shown in FIGS. 14–15, as assembled, taken along line 16—16 in FIG. 15.

Referring to FIGS. 14–16, a side wall 146 of seat 120 includes a recess 148 for receiving spring 144 and locking disk 142. In recess 148 are several, here four, ribs 154 (only two are shown in FIG. 15) extending inward from an interior wall 156 of recess 148. Ribs 154 mate with corresponding slots 158 (portions of only three slots 158 are shown in FIG. 15) defined in an exterior wall 160 of locking disk 142. Ribs 154 and corresponding slots 158 are asymmetrically disposed about a pivot axis 170 to ensure proper orientation of locking disk 142 relative to seat 120. One end of spring 144 fits over a post 150 having an opening 152 and the other end is received over a post 179 of locking disk 142.

A top surface 162 of locking disk 142 defines and includes several annular recesses and annular ridges. An annular ridge 166 is disposed about a periphery of locking disk 142 and defines several notches 168 and 173 at various angular positions relative to pivot axis 170. As shown, notches 168 are locking notches having side walls 172 parallel to pivot axis 170. Notches 173, however, have one side wall 174 angled or sloped relative to pivot axis 170 at an angle 175 to provide cam surfaces. Locking disk 142 also includes two annular ridges 176 and 178 which, together with ridge 166, define annular recesses 164 and 180.

Arm 124 of handle 118 defines a recess 182 between an interior wall 184 and an exterior wall 186 of a hub 188 for receiving ridge 166 of locking disk 142. In the embodiment shown in FIG. 2, the arm 71 and the hub 78 provide the structure of hub 188. Returning to FIGS. 14–16, a radial tab 190 (FIG. 14) extends between interior wall 184 and exterior wall 186 and is sized to fit within notches 168 and 173.

Hub 188 defines several arcuate slots 194 and 196. Three arcuate slots 194 are disposed at a shorter radial distance from pivot axis 170 than four slots 196. Slots 194 are disposed to align with annular recess 180, and slots 196 are disposed to align with annular recess 164, of locking disk 142.

Slots 194 and 196 respectively receive several fingers 198 and 200 of handle locking button 138. Fingers 200 include tabs 202 extending radially outwardly from pivot axis 170. As shown in FIG. 16, fingers 200 are angled slightly radially outward relative to pivot axis 170 so that when fingers 200 extend through slots 196, tabs 202 overlap with top surface 204 of hub 188 to inhibit separation of button 138 from arm 124. Fingers 198 and/or 200 are slidable within arcuate slots 194 and 196, are long enough and strong enough to contact and separate disk 142 from arm 124, and are slidable in recesses 164 and/or 180.

Screw 140 (not shown in FIG. 16) extends through holes 192 and 181 in arm 124 and locking disk 142, respectively, and is received by opening 152 in post 150. Screw 140 has tapered threading and opening 152 has a smaller diameter than the larger-diameter threads of screw 140. Thus, inserting and twisting screw 140 in opening 152 self threads screw 140 in opening 152 by deforming the walls of opening 152. With screw 140 tightened into opening 152, spring 144 biases locking disk 142 against hub 188 of arm 124.

With pivot assembly 139 assembled, handle 118 can be selectively pivoted to one of several positions. With reference to FIG. 16, a user pushes buttons 138 so that fingers 198 and/or 200 push against locking disks 142 to overcome the spring biases of springs 144 to disengage radial tabs 190 from notches 168 or 173 in which they are received and move locking disks 142 into unlocked positions. While locking disks 142 are in the unlocked positions, the user rotates handle 118 to any of the selectable angular orientations provided by notches 168 and 173. Releasing buttons 138 allows the spring force of springs 144 to force locking disks 142 toward arms 124 into locked positions so that radial tab 190 will be forced into one of the notches 168 or 173.

Referring to FIGS. 12 and 14–17, notches 168 are arranged such that handle 118 can be locked into four selectable positions. Tab 190 is in one of notches 168 when handle 118 is in either position 1, 2, 5, or 6 shown in FIG. 17. When handle 118 is in position 1, extension 128 extends from cross member 126 into recess 226 of seat 120, providing a passive crotch restraint for a child seated on seat 120. In this position, handle 118 can support tray 132 as shown in FIGS. 10 and 11. Returning to FIG. 17, when handle 118 is in position 2, extension 128 extends substantially parallel to a length of carrier 114 (similar to FIG. 4) so that the user can conveniently carry carrier 114 when separated from carrier receiving support 116.

Referring again to FIGS. 12 and 14–17, radial tab 190 is disposed within notches 173 when handle 118 is in position 3 or position 4 as shown in FIG. 17. Positions 3 and 4 help carrier 114 be received by an adult chair (not shown). Position 3 can also be used for a feeding position with carrier 114 separated from carrier receiving support 116 by reclining carrier 114 such that handle 118 supports carrier 114. In positions 3 or 4 with carrier 114 received by support 116, handle 118 presents a risk of assembly 110 (although the full assembly 110 is not shown in FIG. 17) being tipped over if a load is placed on cross member 126 or arms 124. Cam surfaces 174 of notches 173 are sloped such that notches 173 will inhibit tab 190 from leaving notch 173 without button 138 being depressed. A sufficient torque, however, applied to handle 118 about pivot axis 170 will force tab 190 against surface 174 such that the force parallel to pivot axis 170 overcomes the spring force of spring 144. Tab 190 thus provides a cam surface that slides over cam surface 174 of locking disk 142, pushing locking disk 142 along axis 170 compressing spring 144. Handle 118 will thus "breakaway" upon sufficient loading of handle 118 when handle 118 is in position 3 or position 4, and thus pivot to position 4 or 5. For example, a load of about 10 pounds directed normal to the surface on which assembly 110 rests (e.g., as indicated by arrows 378 and 380) applied to cross member 126 will cause handle 118 to breakaway. Handle 118 can pivot toward the bottom and front of seat 120 (clockwise as shown in FIG. 17) to guard against the force applied to cross member 126 toppling assembly 110.

Figure 11:
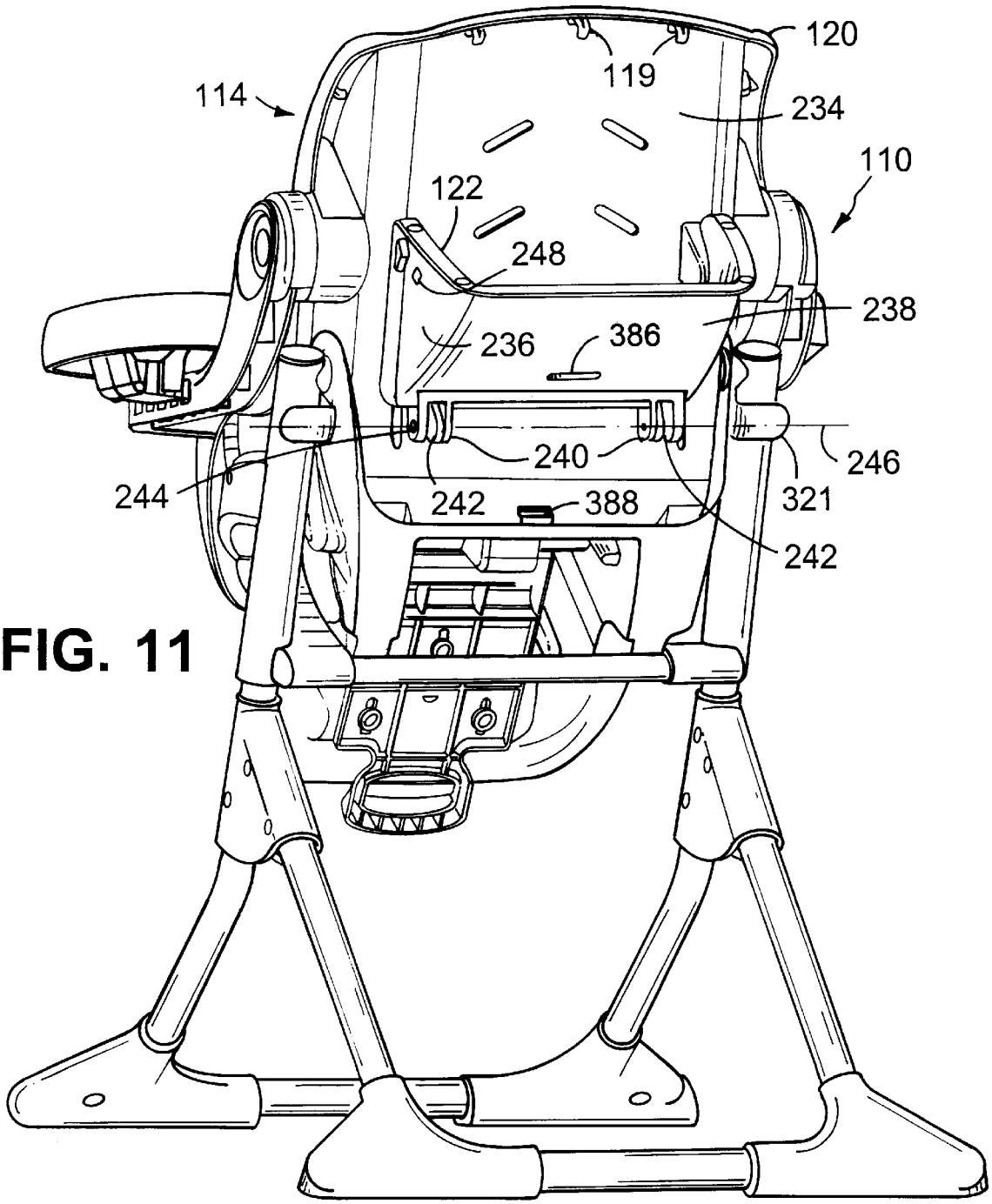
FIG. 11 is a rear perspective view of the chair and carrier shown in FIG. 10.
Figure 18:
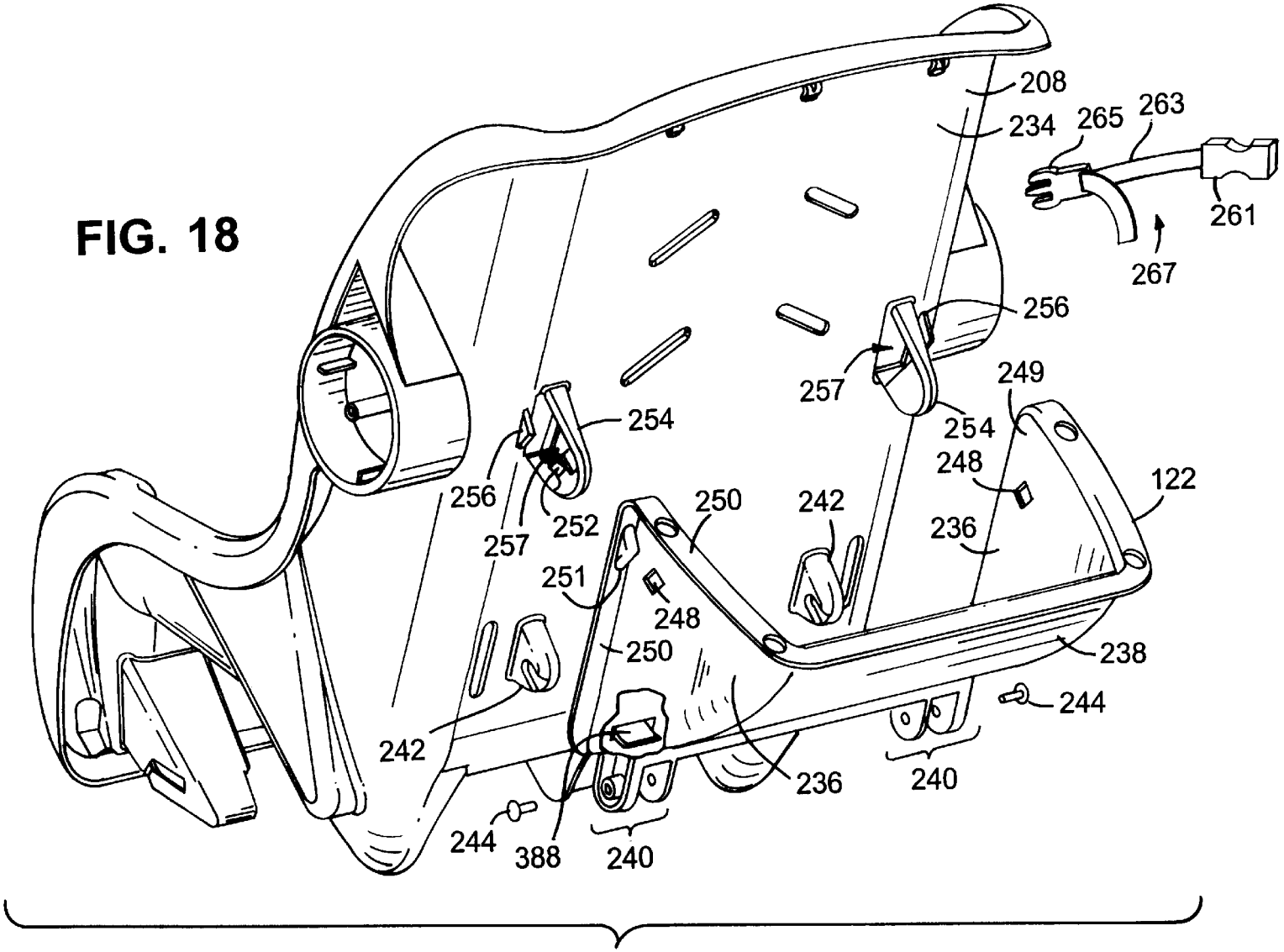
FIG. 18 is an exploded view of a basket and the seat shown in FIG. 10.

Referring to FIGS. 11 and 18, basket 122 is pivotally attached to a rear surface 234 of backrest 208. Basket 122 has two substantially triangular shaped end walls 236 connected by a side wall 238. Two brackets 240 extend from side wall 238 near respective end walls 236. Brackets 240 fit over flanges 242 extending from back surface 234. Pivot pins 244 extend through openings in brackets 240 and flanges 242 to pivotally couple basket 122 to seat 120 along a pivot axis 246 disposed near a vertex of triangular-shaped end walls 236. Especially when basket 122 is in the position shown in FIG. 11, basket 122 and rear surface 234 of seat 120 form a receptacle for receiving and storing items such as toys.

Figure 19:
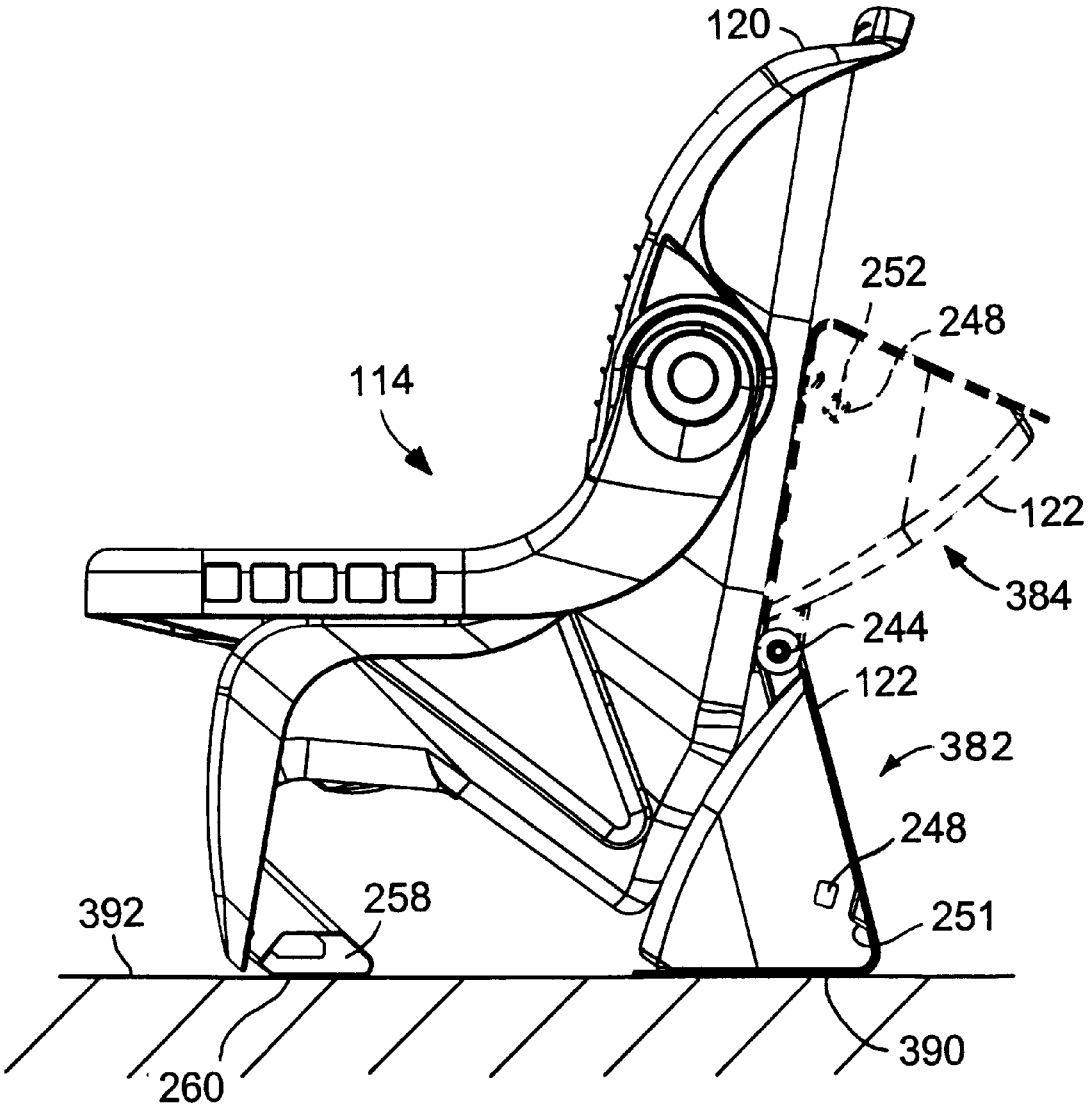
FIG. 19 is a side view of the carrier shown in FIG. 10 in an upright position on a flat surface and with the basket in two positions, one of which is shown in broken lines.

Referring also to FIG. 19, basket 122 can attach to seat 120 in a lower position 382, shown in solid lines, or an upper position 384, shown in dashed lines. As shown in FIG. 19, carrier 114 can be mounted in an upright position on a flat surface 392 with basket 122 in lower position 382. Carrier 114, however, would be unstable and would tend to tip over if placed in the upright position shown in FIG. 19 with basket 122 in upper position 384. End walls 236 define locking openings 248 that receive tabs 252, on brackets 254 extending from rear surface 234, with basket 122 in upper position 384. Each tab 252 extends outward from bracket 254 a sufficient distance and at an angle such that inner surfaces 249 (only one shown in FIG. 18) of basket 122 will slide against and deflect tab 252 inward when receiving tab 252. Tab 252 is positioned to interfere with basket 122 once received by opening 248. Thus, tabs 252 and mating openings 248 help to retain basket 122 in upper position 384. A rim 250 extending around a periphery of basket 122 has a pair of hollow triangular receptacles 251 (only one is shown in FIGS. 11, 18, and 19) that receive triangular tabs 256 extending from rear surface 234. Receptacles 251 and mating tabs 256 help to align basket 122 in upper position 384. To help secure basket 122 in lower position 382, a slot 386 (FIG. 11) in basket 122 is configured to receive a clip 388 extending from, and disposed near the bottom of, seat 120. Clip 388, shown in FIG. 18 through a sectioned portion of basket 122, has a hook shape and extends at an angle from back surface 234 such that basket 122 will deflect clip 388 downward when receiving clip 388, and clip 388 will be positioned to interfere with basket 122 once received by slot 386.

Brackets 254 are adapted to allow seat 120 to be secured to a chair (not shown). Brackets 254 provide openings 257 for receiving a strap 267 (not shown to scale). Strap 267 has a female fastener 261 fixedly attached to one end of a mesh member 263 (e.g., woven nylon or polypropylene) and a mating male fastener 265 adjustably attached to the other end of mesh member 263. Strap 267 can be fed through openings 257 and around the chair, and fasteners 261 and 265 connected and adjusted to tighten strap 267. With strap 267 received through openings 257, strap 267 inhibits receptacles 251 from receiving mating tabs 256, thus helping to prevent basket 122 from being secured in upright position 382. This helps prevent a situation where basket 122 is in upright position 382 and carrier 114 is secured to the adult chair with strap 267, which could be an unsafe arrangement.

Figure 20:
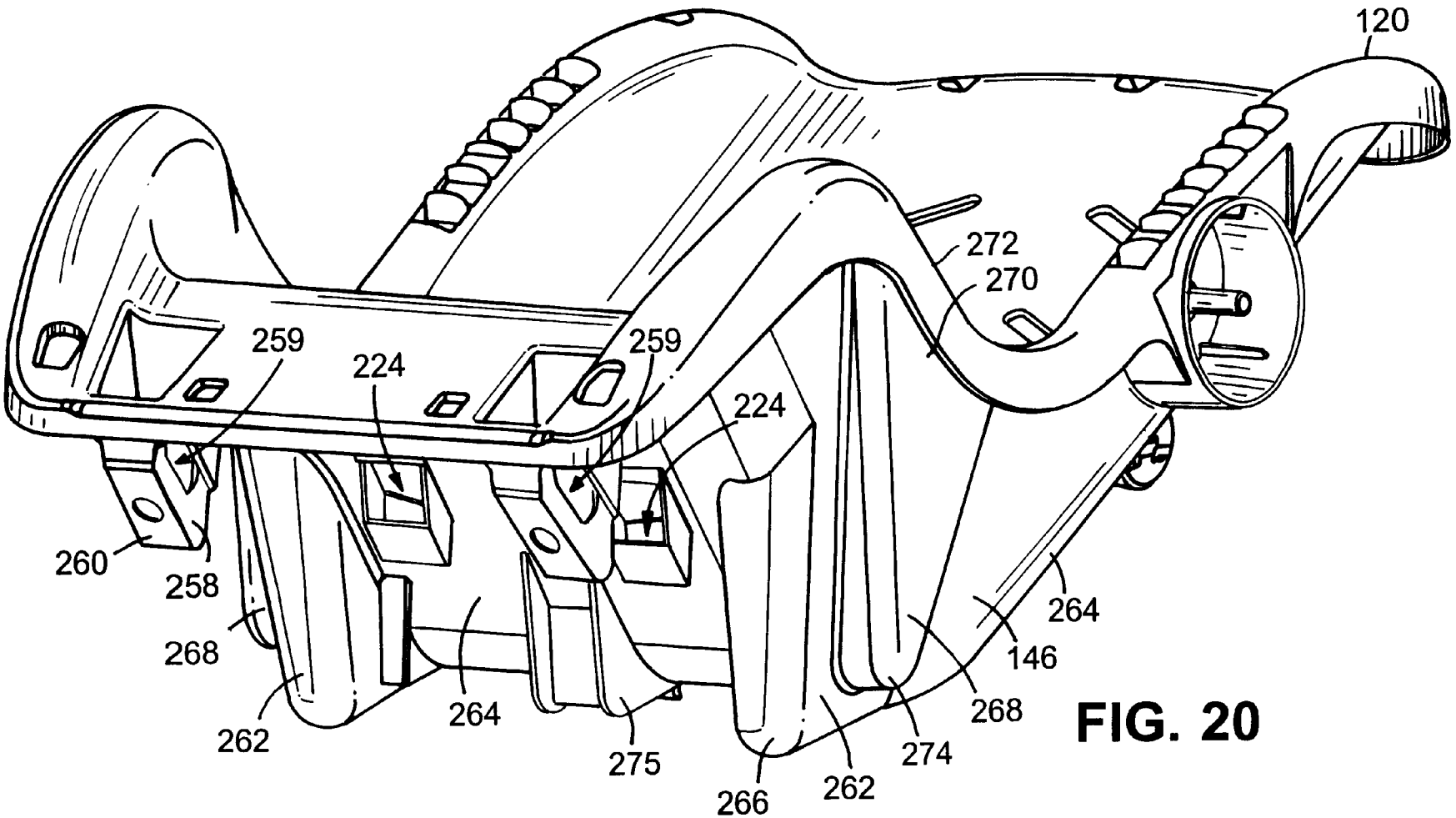
FIG. 20 is a perspective view showing the bottom of the seat shown in FIG. 10.

As shown in FIG. 20, two floor supports 258 extend from a bottom surface 264 of seat 120. Bottom surfaces 260 of supports 258 are disposed and adapted to frictionally engage a surface such as the floor when seat 120 is separated from carrier receiving support 116 (FIG. 12) and rested on a surface in an upright position similar to that shown in FIG. 19. For example, bottom surfaces 260 may be coated or covered with rubber. Also, each floor support 258 provides a through hole 259 for receiving a strap (not shown) for securing seat 120 to a chair (not shown). The strap may be a mesh member with a fastener fixed to one end and a mating fastener adjustably coupled to the other end, similar to strap 267 shown in FIG. 18. Such a strap can be passed through both holes 259 and around the chair, the fasteners connected, and the adjustable fastener manipulated to tighten the strap. Seat 120 also has two slots 224 that extend through seat 120, as shown, for receiving portions of a seat latch described below.

Side walls 146 mate with carrier receiving support 116. Side walls 146 extend toward the bottom rear of seat 120 to form the outside surfaces of two wedge-shaped extensions 262 adapted to fit into carrier receiving support 116 as described below. Extensions 262 have rounded edges 264 and rounded corners 266 and join back surface 234 (FIG. 11) and bottom surface 264 with side walls 146. Each side wall 146 also provides a wedge-shaped rib 268 having a wide end 270 disposed near an arm rest 272 and extending generally toward the bottom and rear of seat 120 to a rounded corner 274. Extending from bottom surface 264 near the rear of seat 120 is a triangular member 275.

Figure 21:
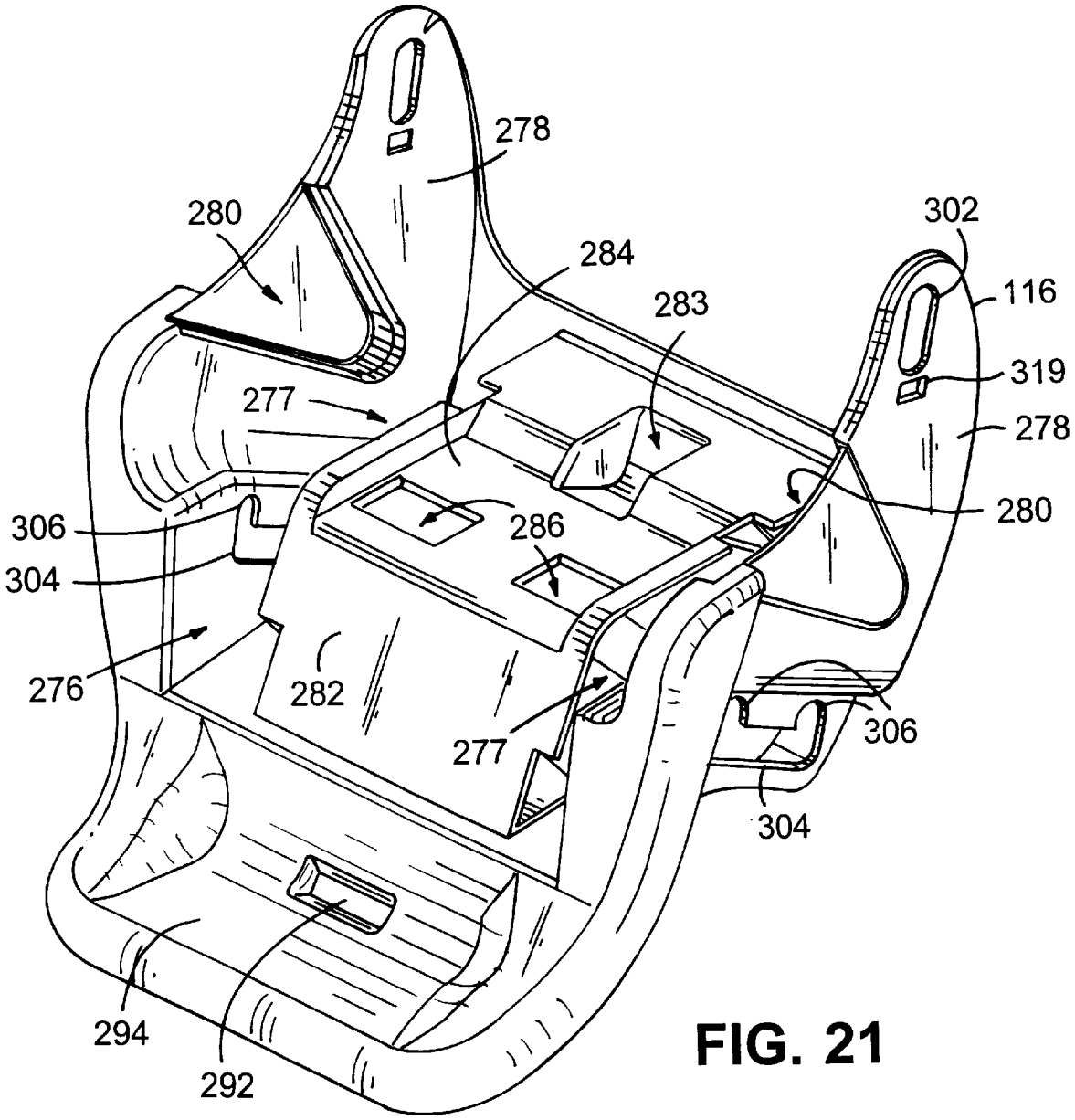
FIG. 21 is a perspective view of a carrier receiving support shown in FIG. 10.

Referring to FIGS. 12 and 21, carrier receiving support 116 defines a trough 276 for receiving seat 120 and aligns seat 120 therein. Side portions 277 of trough 276 receive extensions 262 of seat 120. Pie-shaped or wedge-shaped slots 280 in side walls 278 are adapted to receive ribs 268 (FIG. 20) of seat 120 to help guide seat 120 into support 116. A central member 282 has a recess 283 for receiving triangular member 275 (FIG. 20) of seat 120 and has two holes 286 through its top surface 284 for receiving two prongs 288 of a seat latch 290 (FIGS. 12 and 22).

Figure 22:
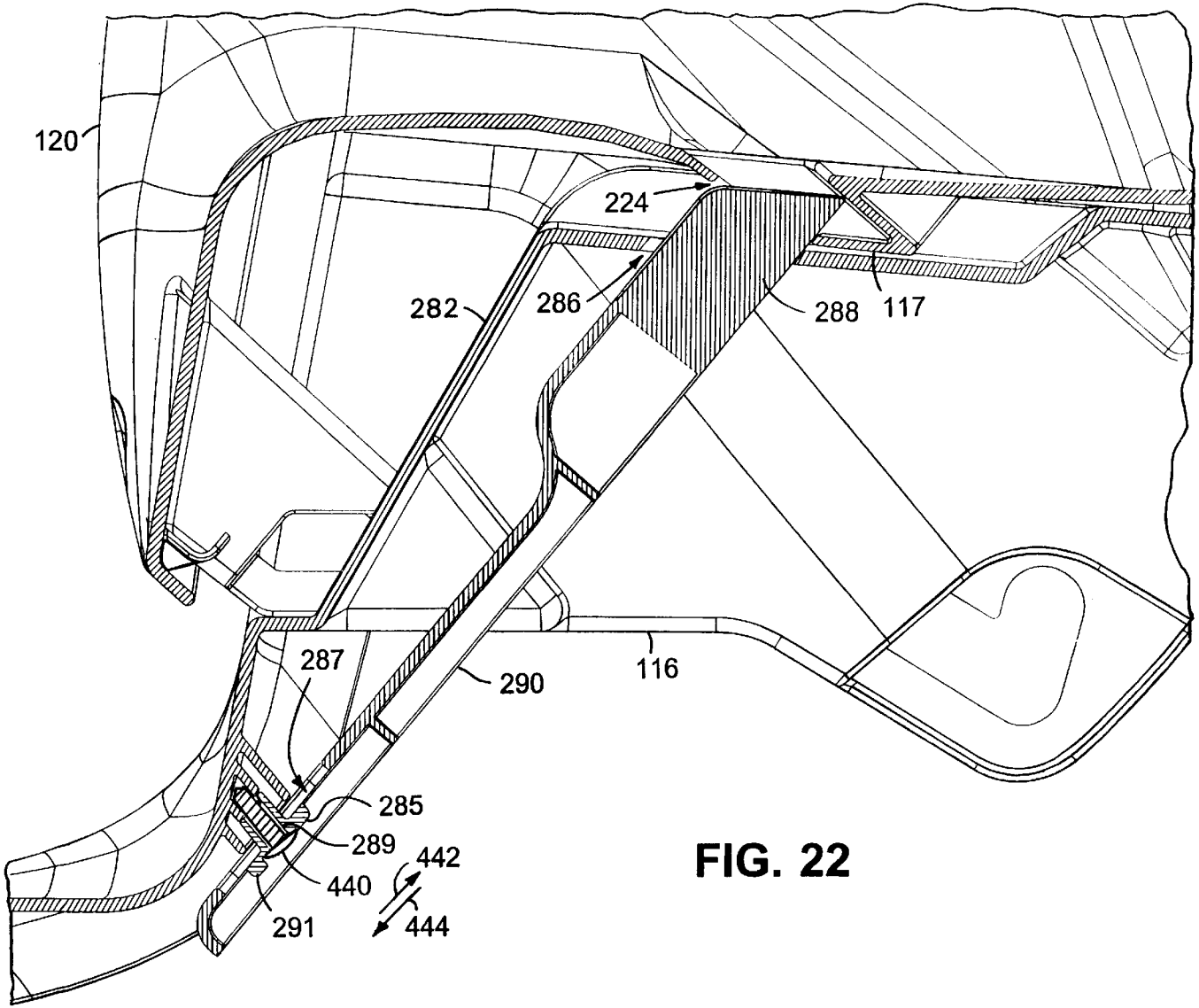
FIGS. 22 and 23 are cross-sectional views through the assembled seat, the carrier receiving support, and a seat latch shown in FIG. 10 taken along lines 22—22 and 23—23, respectively, shown in FIG. 12.
Figure 23:
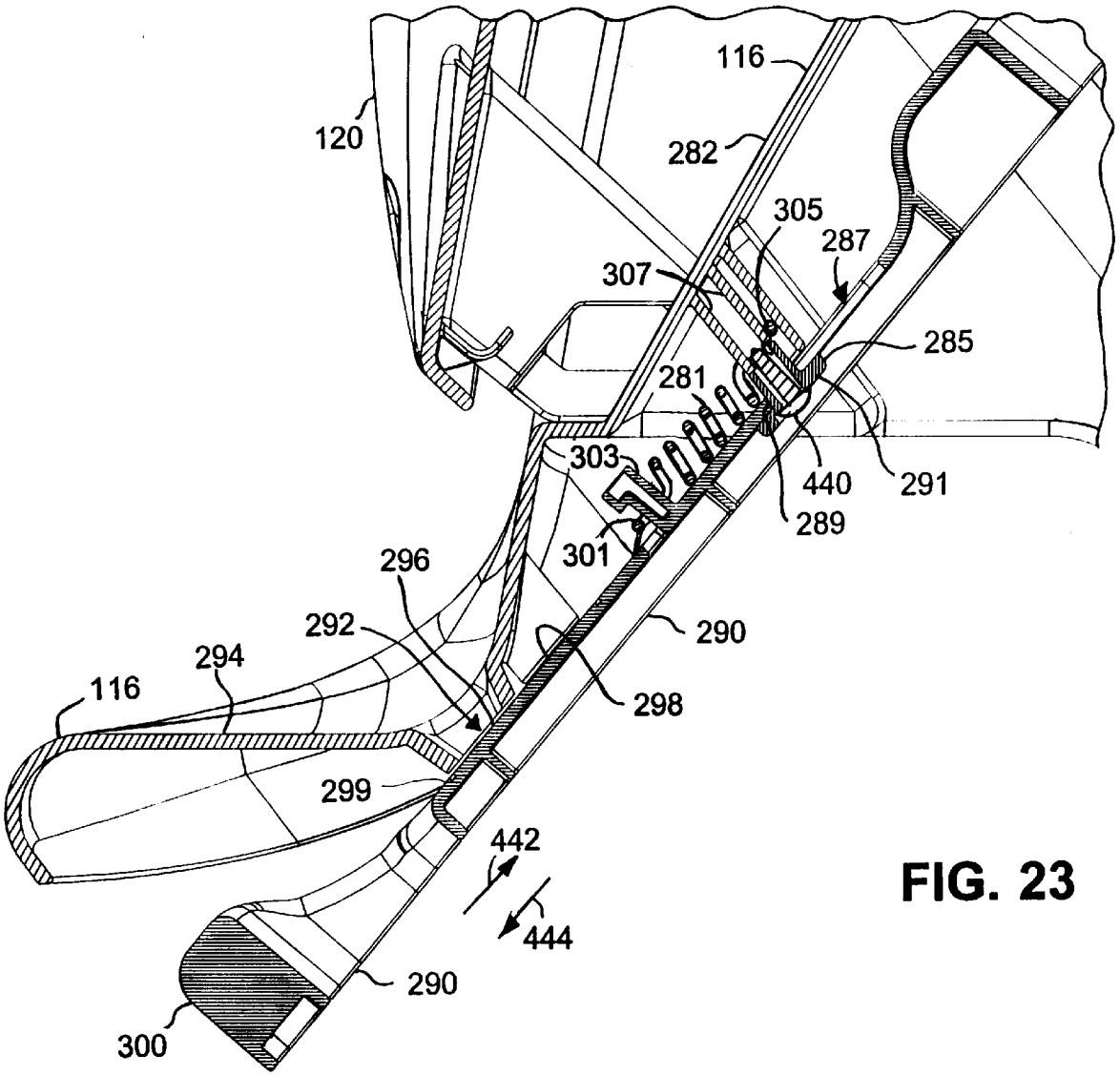

Referring also to FIGS. 22 and 23, seat latch 290 is spring biased by a tension spring 281 such that prongs 288 extend through holes 286 of central member 282. FIG. 22 is a cross-sectional view in a plane passing off-center lengthwise through seat latch 290, including through one of prongs 288 and an off-center one of three retaining bushings 285. FIG. 23 is a cross-sectional view in a plane passing through the center, lengthwise, of seat latch 290, including through an on-center one of retaining bushings 285. Spring 281 has a loop 301 on one end disposed around an L-shaped post 303 of seat latch 290 and a loop 305 on the other end disposed around a pair of ribs 307 of support 116 and one of three retaining bushings 285 (only one is shown in each of FIGS. 22 and 23). Retaining bushings 285 have barrel portions 289 received through slots 287 in seat latch 290. Bushings 285 are secured, such as with self-threading screws 440, to carrier receiving support 116 and have flanged ends 291 disposed against the bottom of seat latch 290, opposite support 116, when secured to support 116. As shown in FIG. 22, prongs 288 (one shown) can pass through holes 286 in support 116 such that seat latch 290 is in a locked position. In the locked position, prongs 288 are received by slots 224 in seat 120 and inhibit removal of seat 120 from trough 276 (FIG. 21) of support 116.

Seat latch 290 provides indications of whether seat 120 is locked, not locked, or not present. When seat 120 is locked into support 116, seat latch 290 is in the locked position as shown in FIGS. 22 and 23. In this position, a portion 296 (FIGS. 12 and 23) of seat latch 290 indicating the locked position can be viewed through a hole 292 in a foot rest portion 294 of carrier receiving support 116. The indication can be, for example, a color indicator such as a green color and/or a word such as "LOCKED" and/or a symbol such as a diagram of a locked padlock. Other portions, such as portions 298 and 299, of seat latch 290 can have other indications such as different colors, e.g., red, and/or words, e.g., "NOT LOCKED" (portion 298) or "NO SEAT" (portion 299), or have a different symbol such as a diagram of an unlocked padlock (portion 298). With seat 120 removed from trough 276 (FIG. 21) of support 116, seat latch 290 is biased, in a direction 303, into openings 286 in support 116 such that portion 299 is visible through hole 292. With seat 120 partially received by trough 276, but without slots 224 receiving prongs 288, a bottom surface 117 of support 116 pushes seat latch 290 in a direction 305 such that portion 298 is visible through hole 292. Thus, portions 298 and 299 are aligned with, and indicate through, hole 292 when seat 120 is present in trough 276 but seat latch 290 is not in the locked position, or that seat 120 is not present in trough 276, respectively. Seat latch 290 includes a hand grip 300 disposed at one end that is accessible when assembly 110 has been assembled regardless of whether seat latch 290 is in the locked position.

Carrier receiving support 116 is adapted to mate with base 112. As shown in FIG. 21, side walls 278 of support 116 include slots 302 and 304, each of slots 304 having three notches 306 along its length. Slots 304 and notches 306 are similar to slots 48 and notches 49 shown in FIGS. 5–7.

Referring to FIGS. 12, 21 and 24–25, base 112 includes a pair of pivot/height adjustment assemblies 308 and a leg assembly 310 adapted to couple to carrier receiving support 116 through slots 302 and slots 306 and in detents 319. Base 112 provides a foundation for carrier receiving support 116 and carrier 114 to form a high chair mountable on a surface such as a floor. Base 112, in conjunction with support 116, provides adjustable height and reclining features for assembly 110.

Figure 24:
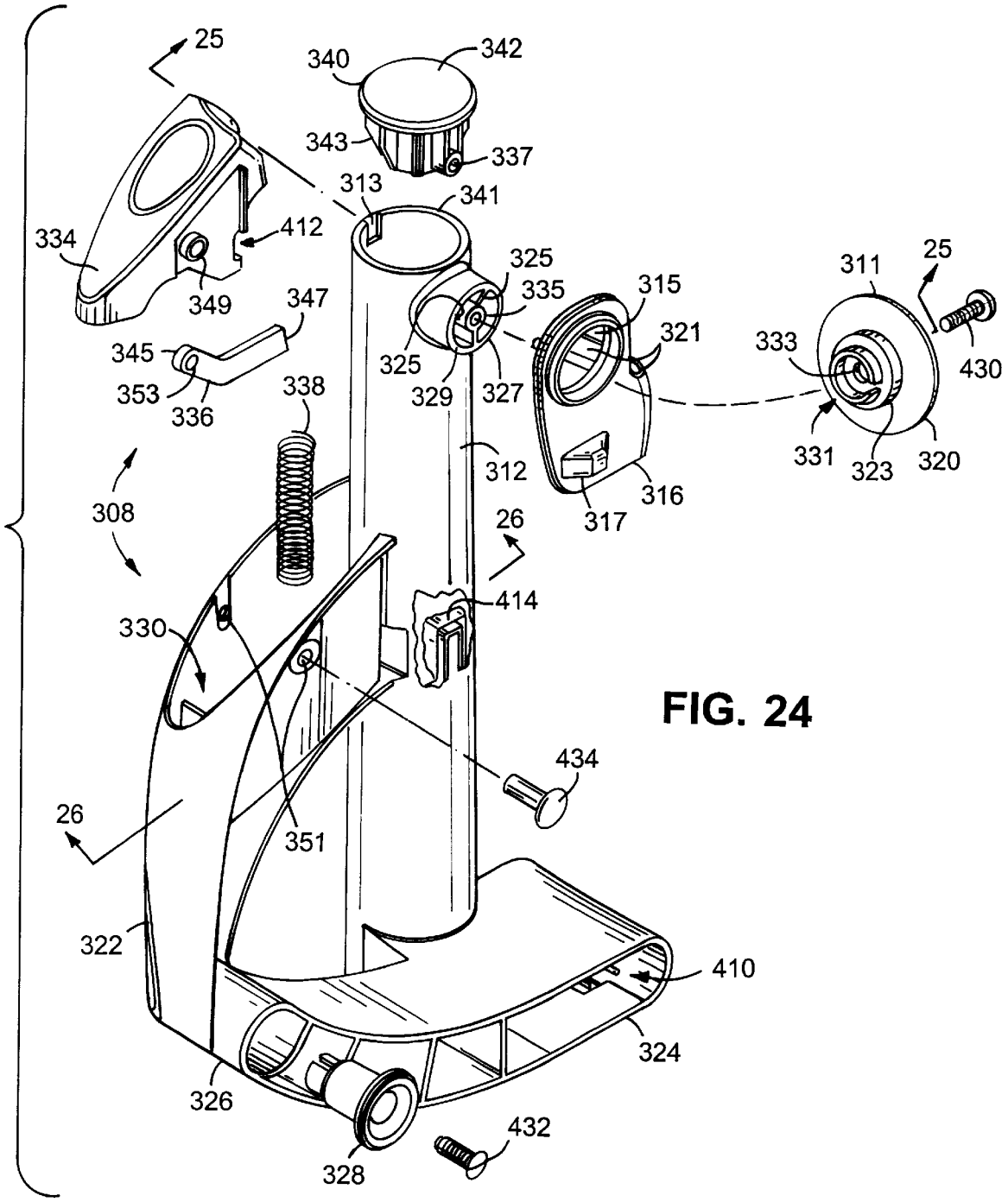
FIG. 24 is an exploded view of a pivot/height adjustment assembly shown in FIG. 12.

As shown in FIG. 24, each assembly 308 includes a tube 312. Tube 312 is adapted to receive a cap 340 and has a recess 313, in an upper end 341, adapted to receive a tab 343 of cap 340 to help align cap 340 within tube 312. With cap 340 received in tube 312, a hole 337 of cap 340 aligns with a through hole 335. An upper end 342 of cap 340 has a diameter approximately equal to the exterior diameter of tube 312.

Figure 25:
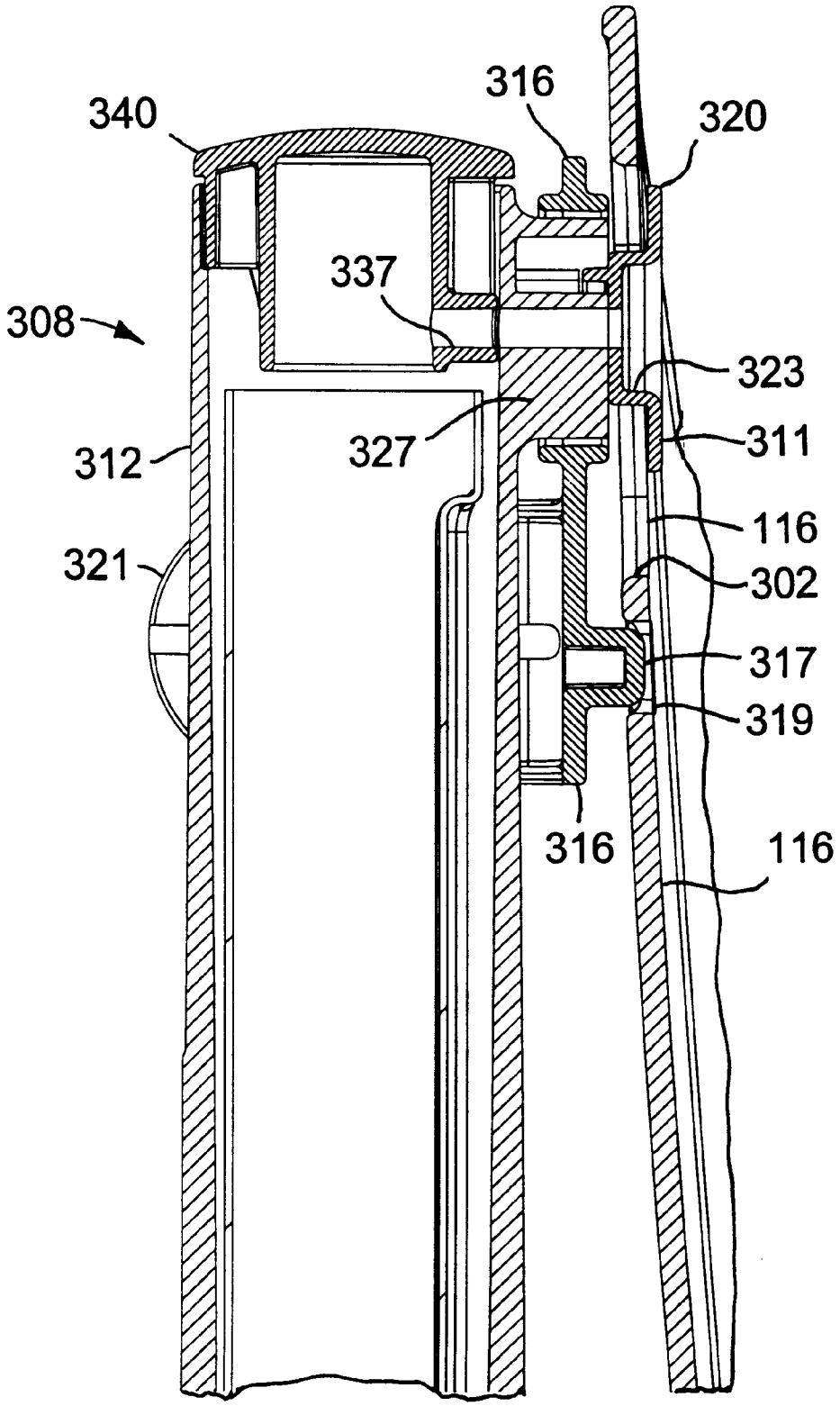
FIGS. 25 and 26 are cross-sectional views of an assembled pivot/height adjustment assembly taken along lines 25—25 and 26—26, respectively, in FIG. 24.

Referring to FIGS. 20, 24 and 25, each assembly 308 is adapted to be slidably coupled through slot 302 (FIG. 21) to support 116 (for clarity, not shown in FIG. 24). A shaft 314 projects from tube 312 and is rotatably received by at least a portion of a hole 315 in a carrier lock 316. Extending within shaft 314 are two spokes 325 and a spoke 327 that extends within, and to an end 329 of, shaft 314. Spoke 327 is received by a slot 331 in an upper pivot mount 320 that is connected to shaft 314, e.g. by inserting a screw 430 through holes 333 and 315 (and slot 302) and self threading screw 430 in holes 335 and 337. Upper pivot mount 320 has a boss 323 that slidably fits within slot 302 of carrier receiving support 116 (FIG. 21) and has a flange 311 with an outer diameter that is larger than a width of slot 302. Securing flange 311 against support 116 helps retain the relationship between tube 312, carrier lock 316, and carrier support 116.

Carrier lock 316 includes a boss 317 adapted to be selectively received in detent 319 in carrier receiving support 116 with seat 120 and support 116 in an upright position (similar to FIG. 5). Boss 317 is shaped to slide across the surface of side wall 278 of support 116 to snap into detent 319. Boss 317 is also shaped with angled sides to be removed from detent 319 by rotating carrier lock 316. An arm 321 (FIG. 11) on carrier lock 316 is adapted to facilitate rotating carrier lock 316 and can interfere with tube 312 to limit the range of rotation of carrier lock 316.

Each assembly 308 also includes an upper arm 322 and a lower arm 324, that are molded as a single piece, mounted to tube 312. Arms 322 and 324 meet at a joint 326. A bushing 328 is slidably coupled through slot 304 or one of slots 306 of support 116 (for clarity, not shown in FIG. 24) to joint 326 by a screw 432 that self threads in joint 326.

In use, assemblies 308 allow seat 120, along with carrier receiving support 116, to be positioned into three different reclining positions, namely upright, partially reclined, and fully reclined, similar to the discussion above with respect to FIGS. 5, 6, and 7 respectively. To reposition seat 120, the user positions carrier locks 316 so that bosses 317 are removed from detents 319. The user lifts carrier receiving support 116, sliding upper pivot mount 320 within slot 302 and sliding bushing 328 from notch 306 into slot 304. Bushing 328 slides in slot 304 as the user adjusts the reclining angle of support 116. At a desired angle corresponding to one of the three notches 306, the user lowers support 116 such that bushing 328 slides into the desired notch 306. If seat 120 and support 116 are in the upright position, the user rotates carrier locks 316 so that bosses 317 snap into detents 319 to inhibit vertical motion of support 116 relative to tubes 312. This helps prevent seat 120 from being undesirably moved within slots 306.

Figure 26:
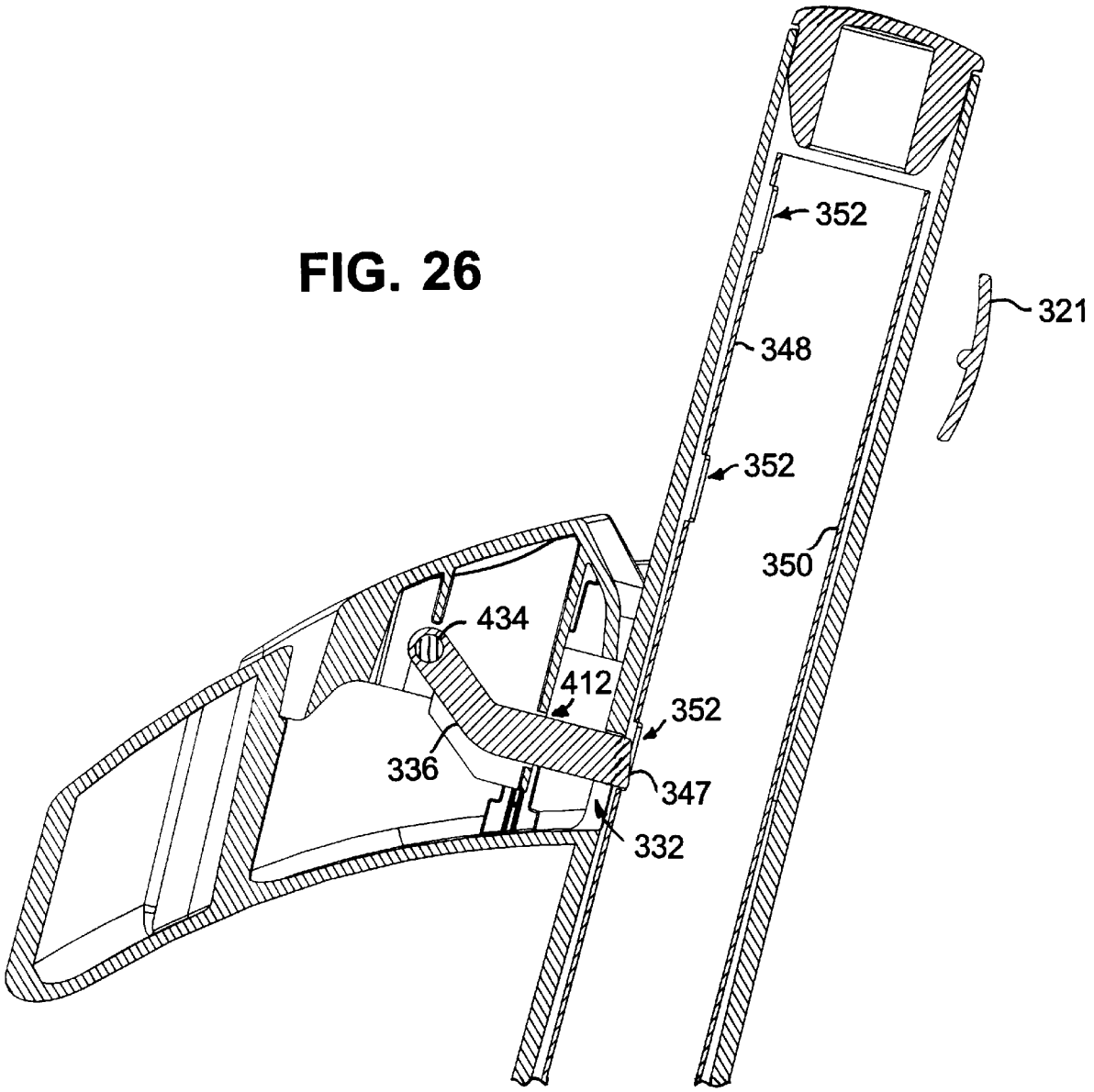

As shown in FIGS. 12, 24, and 26, upper arm 322 and tube 312 define openings 330 and 332 for receiving a height adjust button 334 and a height lock 336 respectively. Height adjust button 334 is pivotally mounted within opening 330 to upper arm 322, e.g., by inserting a rivet 434 through bosses 349 (only one is shown in FIG. 24) and holes 351. Button 334 is spring biased by a compression spring 338 that is received by a post (not shown) on the bottom of height adjust button 334 and an opposing post (not shown) of upper arm 322 similar to the arrangement for spring biasing tray latches 134 discussed above. Button 334 is connected to a first end 345 of height lock 336, e.g., by inserting rivet 434 through hole 353 also. Height lock 336 is made of metal, e.g., steel, and extends through, and is guided by, an opening 412 in button 334 such that a second end 347 of height lock 336 extends through opening 332 in tube 312 and one of three holes 352 in a leg 348 (FIG. 12). A tab 414 extends radially inward within tube 312 and is slidably received by an elongated recess 416 (FIG. 12) in an outer surface of leg 348. As shown in FIG. 26, arm 321 of carrier lock 316 is displaced from tube 312 with boss 317 received by detent 319 (FIG. 25).

The height of seat 120 relative to the surface on which assembly 110 rests can be adjusted using height adjust buttons 334. The user grasps upper support arms 322, lifts slightly, and depresses height adjust buttons 334. Depressing buttons 334 against the spring bias of spring 338 pivots buttons 334 and removes height locks 336 from holes 352 in legs 348. With height locks 336 no longer in holes 352 in legs 348, legs 348 are able to slide within tubes 312. Tabs 414 slide within recesses 416, being inhibited by the ends of recesses 416 to help limit the range of motion of tubes 312 relative to legs 348. The user lifts or lowers tubes 312, on which carrier receiving support 116 and carrier 114 are mounted, to a desired height corresponding to one of the holes 352 in legs 348. The user releases height adjust buttons 334, allowing height locks 336 to extend through the desired holes 352 in legs 348. With height locks 336 extending through openings 332 in tubes 312 and holes 352 in legs 348, legs 348 are inhibited from sliding within tubes 312.

Still referring to FIGS. 12, 24 and 26, leg assembly 310 includes a front frame 344 and a rear frame 346. Front frame 344 has a tubular construction with two legs 348 having upper ends 350 configured to fit within tubes 312. Upper ends 350 have several holes 352 configured to receive ends 347 of height locks 336 extending through openings 332 in tubes 312. Rear frame 346 has a tubular construction and is connected to front frame 344 to provide a stable foundation for assembly 110.

Legs 348 of front frame 344 are bent to project forward toward a cross tube 354 connecting legs 348. Legs 348 and cross tube 354 can be formed as a unitary piece and made of metal, e.g., steel. At the junction between legs 348 and cross tube 354 are feet 356 and 357, foot 356 being a mirror image of foot 357.

Foot 357 includes two halves, an upper half 358 and a lower half 360. These halves 358 and 360 are configured to receive approximately half the circumference of each of leg 348 and cross tube 354. Halves 358 and 360 sandwich the junction between leg 348 and cross tube 354, and a portion of leg 348 and cross tube 354, and are secured together to form foot 357 such as by being screwed together or sonic welded. Feet 356 and 357 project outwardly of legs 348 to provide a wider base than the frame 344 provides.

Figure 27:
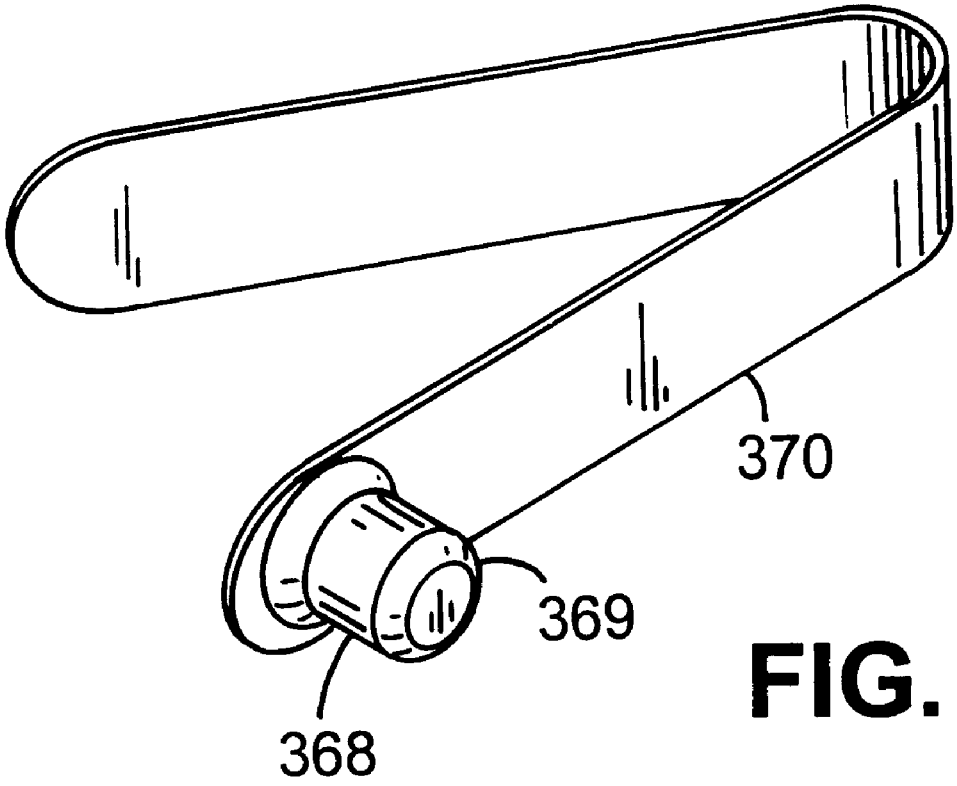
FIG. 27 is a perspective view of a snap button.

Rear frame 346 is pivotally coupled to front frame 344 by collars 362 and 363 and snap buttons 370, one of which is shown in FIG. 27. Collars 362 and 363 are mirror images and are unitary injection molded pieces made of, e.g., polypropylene. Collars 362 and 363 receive legs 348 of front frame 344 and legs 364 of rear frame 346. Rear frame 346 is pivotally connected, e.g., by riveting, to collars 362 and 363 about a pivot axis corresponding to holes 366 in collars 362 and 363. Legs 364 project rearwardly of front frame 344 when base 112 is in a non-collapsed position. Legs 364 are hollow and receive snap buttons 370. Snap buttons 370 outwardly spring bias posts 368 through holes 372 (only one is shown in FIG. 12) in legs 364. Posts 368 are adapted to be received by holes 373 (only one is shown in FIG. 12) in collars 362 and 363. Recess, not shown, in interior surfaces of collars 362 and 363 are adapted to partially receive rounded ends 369 of posts 368 near legs 348 when base 112 is in a collapsed position. With posts 368 received by these recesses, legs 364 are inhibited from pivoting relative to legs 348. Legs 364 can be pivoted, however, upon application of enough torque to force rounded ends 369 against walls of the recesses to produce enough force to overcome the spring biases of snap buttons 370.

Similar to front frame 344, legs 364 of rear frame 346 are joined by a cross tube 374 at junctions enclosed by feet 356 and 357. Another cross tube 376 is adapted to be received by cavities 410 of, and thereby connect, lower arms 324 (FIG. 24) to provide assembly 110 with additional stability. Cross tube 376 is riveted to lower arms 324. Legs 364 and cross tubes 374 and 376 are made of metal, e.g., steel.

In use, assembly 110 provides a combination of a high chair and infant carrier. In the configuration shown in FIG. 10, assembly 110 provides an adjustable-height, reclining high chair with a passive crotch restraint and a basket 122 for storing items. Carrier 114 can be removed from carrier receiving support 116 to provide an infant carrier.

To achieve the high chair configuration shown in FIGS. 10–11, the user inserts and locks carrier 114 into carrier receiving support 116. To do this, the user inserts seat 120 into trough 276 by sliding ribs 268 into slots 280 and inserting triangular member 275 into recess 283. Having triangular member 275 and recess 283 helps guard against the user inserting carrier 114 into support 116 incorrectly. For example, if carrier 114 is oriented such that member 275 rests on surface 284 of central member 282, then member 275 preferably will cause carrier 114 to wobble, indicating an unstable, undesirable arrangement of carrier 114 and support 116. Interaction of ribs 286 with slots 280 will align seat 120 within trough 276.

As the user inserts carrier 114 into support 116, carrier 114 is locked into support 116 by operation of seat latch 290. As seat 120 is guided into support 116, bottom surface 117 of seat 120 engages prongs 288 of seat latch 290, pushing seat latch 290 downward and forward in direction 305 (FIGS. 22 and 23). Retaining bushings 28S retain and guide, and interact with walls of slots 287 to limit the range of motion of, seat latch 290 relative to support 116. The portion of seat latch 290 showing through window 292 changes from portion 299, indicating no seat, to portion 298, indicating that seat 120 is not locked. When seat 120 has been fully received within trough 276, the spring bias on seat latch 290 forcing seat latch 290 in direction 303 (FIGS. 22 and 23) will force prongs 288 into openings 224 in seat 120, locking seat 120 into place. The portion of seat latch 290 showing through window 292 changes from portion 298 to portion 296, indicating that seat 120, and thus carrier 114, is locked into position.

Carrier 114 can be separated from carrier receiving support 116 when seat latch 290 is unlocked. To unlock seat latch 290, grip 300 of seat latch 290 is pulled downwardly and forwardly in direction 305 until prongs 288 will not interfere with seat 120 as carrier 114 is slid out from support 116. That prongs 288 are sufficiently out of the way is indicated by the portion of seat latch 290 showing through window 292 changing to portion 298 or portion 299. Carrier 114 is pulled from support 116, e.g., by pulling on handle 118, to slide seat 120 in a direction opposite to that for inserting carrier 114 into support 116. Once removed, carrier 114 can be used, e.g., to transport the child and to place the child on a variety of surfaces in, e.g., an upright or sitting position or a reclining position.

As shown in FIG. 19, basket 122 can serve as a support member or stabilizer to help orient, support and stabilize carrier 114 in the upright and reclining positions. Basket 122 can be placed in lower position 382 or upper position 384. In upper position 384, basket 122 can be used to store items. Referring also to FIGS. 11 and 18, to put the basket 122 in upper position 384, basket 122 is rotated until mating tabs 256 are received by receptacles 251 and openings 248 receive tabs 252. Basket 122 is released from the upper position 384 by pushing tabs 252 through openings 248 and rotating basket 122 away from the back surface 234 of seat 120. To place basket 122 in lower position 382, basket 122 is rotated until slot 386 receives clip 388. In lower position 382, clip 388 inhibits basket 122 from rotating about pivot axis 246, and surface 390 is substantially parallel with bottom surface 260 of floor supports 258. In this position, carrier 114 can be rested on surface 392, with basket 122 providing stability to carrier 114. Basket 122 is released from lower position 382 by pushing clip 388 through slot 386 and rotating basket 122 upwardly toward the back surface 234 of seat 120.

Assembly 110 can be manipulated, including being disassembled to some degree, to help reduce space for storing assembly 110. To reduce space occupied by assembly 110, tray 132 can be removed and handle 118 can be rotated into a desired position (e.g., positions 1 or 6 shown in FIG. 17). Also, carrier 114 can be separated from support 116, support 116 can be separated from base 112, and base 112 can be collapsed. To collapse base 112, posts 368 of snap buttons 370 are pushed against the spring bias of snap buttons 370 such that posts 368 are removed from holes 373 in collars 362 and 363. Legs 364 are rotated toward legs 348 into a collapsed position such that posts 368 slide along the interior surface of collars 362 and 363 and have their rounded ends 369 snap into recesses (not shown) on these interior surfaces. Receiving rounded ends 369 of posts 368 in these recesses helps to retain legs 364 in the collapsed position. It also permits removal of posts 368 from these recesses and rotation of legs 364 toward the non-collapsed position upon exertion of a sufficient torque.

Other embodiments are within the scope of the following claims.

What is claimed is:

1. A chair and carrier assembly comprising:

a base;

a carrier receiving support mounted to the base and adapted to receive a carrier; and a carrier removably received in the carrier receiving support, the carrier including a seat, for holding a child, and a handle including arms joined by a cross member, the arms pivotally mounted to the seat, and including an elongated member transversely extending from the cross member for carrying the carrier when the handle is in a first position and for providing a passive restraint for the child when the handle is in a second position;

wherein the carrier is removable from the carrier receiving support.

2. The assembly of claim 1 wherein the seat includes upper and lower seat portions for receiving upper and lower portions of the child respectively, and wherein the elongated member extends from the cross member substantially to the lower seat portion when the handle is in the second position.

3. The assembly of claim 2 wherein the elongated member extends substantially parallel to a length of the carrier when the handle is in the first position.

4. The assembly of claim 1 wherein the seat provides a recess for receiving an end of the elongated member.

5. The assembly of claim 1 wherein the base includes a pair of pivot supports each including a positioning pin, and wherein the carrier receiving support defines a corresponding plurality of slots having notches for receiving the positioning pins, wherein the pins are slidable within the slots and are receivable in the notches to restrict movement of the carrier receiving support relative to the base.

6. The assembly of claim 1 wherein the carrier comprises a rib and the carrier receiving support defines a slot for receiving the rib.

7. The assembly of claim 6 wherein the rib is disposed on an exterior side surface of the seat, and wherein a side wall of the carrier receiving support defines the slot.

8. The assembly of claim 1 further comprising a seat latch slidably coupled to the carrier receiving support and spring-biased toward the carrier, wherein the seat defines a cavity for receiving a portion of the seat latch to inhibit separation of the carrier and carrier receiving support when the carrier is received by the carrier receiving support.

9. The assembly of claim 8 wherein the seat latch and carrier receiving support provide an indication of whether the seat latch is in a locked position.

10. The assembly of claim 9 wherein the seat latch and carrier receiving support provide indicia of whether the carrier is received by the carrier receiving support and, if so, whether the carrier is partially or fully received by the carrier receiving support.

11. The assembly of claim 1 wherein at least one of the arms comprises a tab, the carrier including a locking member nonrotatably coupled to the seat, the locking member having at least one engaging surface angled with respect to a handle pivot axis and disposed to interfere with the tab as the handle pivots to inhibit pivotal motion of the handle relative to the seat.

12. The assembly of claim 11 wherein the locking member is slidable relative to the seat to a first position where the tab and engaging surface interfere when the handle is pivoted and to a second position where the handle pivots substantially free of interference between the tab and the engaging surface.

13. The assembly of claim 1 further comprising a support member pivotally attached to a rear surface of the seat and adapted to support the seat in upright and reclining positions when the carrier is detached from the carrier receiving support.

14. The assembly of claim 13 wherein the support member comprises two substantially triangular-shaped walls and a coupling member coupled between the two walls, and wherein the support device pivots relative to the seat about a support member pivot axis near a vertex of each of the walls.

15. A chair and carrier assembly comprising:

a carrier including a seat for holding a child and a handle including a pair of arms pivotally mounted to the seat, at least one of the arms including a tab;

a carrier receiving support adapted to removably receive the carrier; and a base adapted to receive the carrier receiving support;

wherein the carrier defines a recess for receiving the tab, the recess being partially defined by a wall disposed at an angle relative to a pivot axis of the at least one arm, the wall inhibiting pivotal motion of the handle relative to the seat when the tab is received in the recess.

16. A chair and carrier assembly comprising:

a carrier including a seat for holding a child and a handle including a pair of arms pivotally mounted to the seat and connected by a cross member; and a base adapted to be removably coupled to the carrier and to support the carrier above a flat surface;

wherein the carrier includes a pair of engaging surfaces configured to engage each other to inhibit pivoting of the handle while a torque applied to the handle relative to the carrier is less than a predetermined torque.

17. The assembly of claim 16 wherein a first one of the arms is mounted to the seat to pivot about a pivot axis and includes one of the engaging surfaces, and wherein the other one of the engaging surfaces is angled with respect to the pivot axis.

18. The assembly of claim 17 wherein the carrier includes a locking member nonrotatably coupled to the seat and slidable relative to the seat to a first relative position in which the pair of engaging surfaces can interfere when the handle is pivoted and to a second relative position in which the handle can pivot substantially free of interference between the pair of engaging surfaces.

19. The assembly of claim 18 wherein the locking member is slidable relative to the seat in a direction parallel to the pivot axis and is spring-biased into the first relative position.

20. The assembly of claim 18 wherein the first arm includes a tab and the locking member defines a plurality of radial notches for receiving the tab, a first one of the notches having walls substantially parallel to the pivot axis to substantially prevent pivoting of the handle when the tab is received by the first notch and a second one of the notches having the angled engaging surface.

21. The assembly of claim 20 wherein the second notch and the tab are disposed such that the cross member is disposed behind a rear surface of the seat when the tab is received by the second notch.

22. A high chair comprising:

a plurality of legs;

a carrier receiving support coupled to at least a pair of the legs; and a carrier removably mounted to the carrier receiving support and including a seat that defines a chamber for holding an infant, the chamber including an upper-body receiving portion and a lower-body receiving portion, the carrier further including a substantially U-shaped handle including first and second arms connected by a cross member, the arms being pivotally mounted to the seat along a pivot axis, the first arm including an engaging tab, the handle further including an elongated member extending from the cross member toward the lower-body receiving portion of the seat when the handle is in a first position and extending substantially parallel to a length of the seat when the handle is in a second position;

wherein the carrier defines a plurality of recesses, disposed about the pivot axis, for receiving the tab, a first one of the recesses being partially defined by a wall configured to interfere with the tab to permit pivotal motion of the handle relative to the seat when a loading of the handle exceeds a predetermined loading and the tab is received by the first recess.

23. The high chair of claim 22 further comprising a stabilizer pivotally mounted to a rear surface of the seat for supporting the seat in upright and reclining positions, relative to a flat surface, when separated from the carrier receiving support.

* * * * *